US007108618B2

(12) United States Patent
Frischmon et al.

(10) Patent No.: US 7,108,618 B2
(45) Date of Patent: Sep. 19, 2006

(54) APPARATUS AND METHOD FOR REPAIRING A HOCKEY STICK SHAFT

(76) Inventors: Timm J. Frischmon, 548 154th Ave. NE., Ham Lake, MN (US) 55304; Barry S. Bjugstad, 2874 Lisbon Ave. North, Lake Elmo, MN (US) 55042; Michael Bayer, 3403 131st Ave. NE., Blaine, MN (US) 55449

( * ) Notice: Subject to any disclaimer, the term of this patent is extended or adjusted under 35 U.S.C. 154(b) by 0 days.

(21) Appl. No.: 10/993,213

(22) Filed: Nov. 19, 2004

(65) Prior Publication Data

US 2005/0176529 A1 Aug. 11, 2005

Related U.S. Application Data

(60) Provisional application No. 60/523,416, filed on Nov. 19, 2003, provisional application No. 60/530,367, filed on Dec. 16, 2003, provisional application No. 60/559,273, filed on Apr. 1, 2004.

(51) Int. Cl.
*A63B 59/14* (2006.01)

(52) U.S. Cl. ..... 473/560

(58) Field of Classification Search ..... 473/560–564
See application file for complete search history.

(56) References Cited

U.S. PATENT DOCUMENTS 3,129,003 A * 4/1964 Mueller et al. ..... 473/568
3,638,942 A 2/1972 Bassett
3,934,875 A 1/1976 Easton et al.
4,086,115 A 4/1978 Sweet et al.
4,148,482 A * 4/1979 Harwell et al. ..... 473/561
4,361,325 A 11/1982 Jansen
4,591,155 A 5/1986 Adachi
4,968,032 A 11/1990 Redekop
5,050,878 A 9/1991 Deleris
5,303,916 A 4/1994 Rodgers
5,419,553 A 5/1995 Rodgors
5,447,306 A 9/1995 Selden
5,496,027 A 3/1996 Christian et al.
5,549,947 A 8/1996 Quigley et al.
5,607,154 A * 3/1997 Meumann et al. ..... 473/562
5,609,336 A * 3/1997 Tashjian ..... 473/560
5,628,509 A 5/1997 Christian
5,636,836 A 6/1997 Carroll et al.
5,695,416 A 12/1997 Christian
5,746,955 A 5/1998 Calapp et al.
5,816,961 A * 10/1998 Kraemer ..... 473/560

(Continued)

FOREIGN PATENT DOCUMENTS

CA 847193 7/1970

(Continued)

*Primary Examiner*—Mark S. Graham
(74) *Attorney, Agent, or Firm*—Patterson Thuente Skaar & Christensen P.A.

(57) ABSTRACT

The invention is directed to methods and apparatus for repairing fractured, hollow-shafted hockey sticks. In one aspect, the invention comprises a shaft repair insert for joining together a broken hockey shaft so as to define a unitary, repaired hockey stick. In another aspect, the invention comprises a shaft repair sleeve for joining together a broken hockey shaft so as to define a unitary, repaired hockey stick. In another aspect, the invention is directed to a blade receiving insert capable of repairing a hockey shaft having a fracture proximate a blade receiving end. In another aspect, the invention is directed to a shaft extension member for repairing or adjusting the length of hockey shaft.

19 Claims, 25 Drawing Sheets

U.S. PATENT DOCUMENTS

| | | | |
|---|---|---|---|
| 5,823,901 | A | 10/1998 | Burger |
| D404,449 | S | 1/1999 | Burger |
| 5,863,269 | A | 1/1999 | Filice |
| 5,865,696 | A | 2/1999 | Calapp et al. |
| D412,554 | S | 8/1999 | Gleason |
| 5,943,767 | A | 8/1999 | Milam |
| 6,001,035 | A | 12/1999 | Roberts |
| 6,033,328 | A | 3/2000 | Bellefleur et al. |
| 6,062,995 | A | 5/2000 | Murphy et al. |
| D430,249 | S | 8/2000 | Burger |
| D431,273 | S | 9/2000 | Burger |
| 6,117,029 | A | 9/2000 | Kunisaki et al. |
| D435,614 | S | 12/2000 | Illiano |
| 6,206,793 | B1 | 3/2001 | Burger |
| D440,617 | S | 4/2001 | Goldsmith |
| 6,224,505 | B1 | 5/2001 | Burger |
| 6,241,633 | B1 | 6/2001 | Conroy |
| 6,248,031 | B1 * | 6/2001 | Brodie ..... 473/560 |
| 6,267,697 | B1 | 7/2001 | Sulenta |
| 6,274,230 | B1 | 8/2001 | Sarrelongue et al. |
| D458,329 | S | 6/2002 | Clark, Jr. et al. |
| 6,626,775 | B1 | 9/2003 | Tiitola |
| 2002/0052257 | A1 | 5/2002 | Woldum |
| 2002/0065154 | A1 | 5/2002 | Goldsmith et al. |
| 2003/0100390 | A1 | 5/2003 | Bellefleur et al. |
| 2003/0119612 | A1 | 6/2003 | Goldsmith et al. |

FOREIGN PATENT DOCUMENTS

| | | |
|---|---|---|
| CA | 2060962 | 8/1992 |
| CA | 2047567 | 1/1993 |
| CA | 2228104 | 9/1998 |
| CA | 2351827 | 12/2002 |

* cited by examiner

APPARATUS AND METHOD FOR REPAIRING A HOCKEY STICK SHAFT

RELATED APPLICATIONS

The present application claims priority to U.S. Provisional Application No. 60/523,416 filed Nov. 19, 2003, entitled, "APPARATUS AND METHOD FOR REPAIRING A HOCKEY STICK SHAFT," U.S. Provisional Application No. 60/530,367 filed Dec. 16, 2003, entitled, "APPARATUS AND METHOD FOR REPAIRING A HOCKEY STICK SHAFT," and U.S. Provisional Application No. 60/559,273 filed Apr. 1, 2004, entitled, "APPARATUS AND METHOD FOR REPAIRING A HOCKEY STICK SHAFT," each of which is herein incorporated by reference to the extent not inconsistent with the present disclosure.

FIELD OF THE INVENTION

The present invention relates to an apparatus and method for repairing a broken hockey stick. More specifically, the present invention relates to a repair member adapted to attach and retain a first shaft portion, a first hockey stick shaft portion and a second hockey stick shaft portion in an aligned relation so as to define a repaired hockey stick shaft.

BACKGROUND OF THE INVENTION

Over the years, advancements in material technology have lead to increased sophistication in the manufacturing and performance of hockey sticks. Traditionally, hockey sticks were manufactured primarily of wood with a fiberglass covering on the blade portion. The wood stick comprised a solid shaft either machined of a single piece of wood or by sandwiching multiple layers of wood together. These solid shafts were typically very durable but suffered somewhat from increased weight as well as limited flexibility.

Through the use of advanced material technologies, modern hockey sticks are often manufactured of a wide variety of materials. In addition to the aforementioned wood and fiberglass, newer materials including lightweight metals, such as aluminum, and high performance polymers and composite materials such as, for example Kevlar®, graphite, ABS, carbon fiber and ceramics are being used either individually or in combination. Using these new materials, stick suppliers such as Hillerich & Bradsby, CCM, Christian Brothers, Cooper, Mission, Hespeller and Bauer/Nike have been able to alter hockey stick performance to alter and tune stick characteristics such as weight and stick flex.

One way in which these new materials have affected stick construction is through the development of hockey sticks having hollow shafts. These sticks can be manufactured of any of the aforementioned materials and can be either one-piece designs, such as the Easton Synergy™, Louisville Response™, or Mission M1™ models, or they can include removable/replaceable blades and shaft extensions to vary the overall stick length. Representative hollow shaft designs include U.S. Pat. No. 3,934,875 to Easton et al.; U.S. Pat. No. 4,086,115 to Sweet, Jr. et al.; U.S. Pat. No. 4,361,325 to Jansen; U.S. Pat. No. 5,303,916 to Rodger; U.S. Pat. No. 5,419,553 to Rodgors; U.S. Pat. No. 5,447,306 to Selden; U.S. Pat. No. 5,496,027 to Christian et al.; U.S. Pat. No. 5,549,947 to Quigley et al.; U.S. Pat. No. 5,628,509 to Christian; U.S. Pat. No. 5,636,836 to Carroll et al.; U.S. Pat. No. 5,695,416 to Christian; U.S. Pat. No. 5,746,955 to Calapp et al.; U.S. Pat. No. 6,117,029 to Kunisaki et al.; U.S. Pat. No. 6,206,793 to Burger; U.S. Pat. No. 6,224,505 to Burger; U.S. Pat. No. 6,241,633 to Conroy; U.S. Pat. No. 6,267,697 to Sulenta; as well as U.S. Design Pat. Nos. 404,449 to Burger; 430,249 to Burger; 431,273 to Burger; and 458,329 to Clark, Jr. et al. and U.S. Patent Application Publications Nos. 2002/0065154A1 to Goldsmith et al.; and 2003/0119612A1; all of these patents, design patents and patent applications being hereby incorporated by reference to the extent not inconsistent with the present disclosure. With the development of these technologically advanced hockey sticks, suppliers have been able to charge a premium when selling these high performance hockey sticks to the public.

One drawback to the new shaft designs is that with a hollow shaft, the user has an increased potential to break the stick in the shaft as opposed to more traditional blade breakages. As the new shaft and stick designs often have a significant replacement cost associated with them, this can lead to significant warranty and service issues for suppliers was well as frustration on the part of consumers.

SUMMARY OF THE INVENTION

In one aspect, the present invention comprises a repair member for use in repairing hollow shafted hockey sticks. In one presently preferred embodiment, a shaft repair insert can quickly and safely repair a broken, hollow-shafted hockey stick so as to restore the hockey stick to its prior condition such as, for example, similar performance, appearance and overall usability. The shaft repair insert of the present invention allows suppliers to provide users with a repair option allowing them to substantially decrease and eliminate warranty replacement costs as well as negative perceptions associated with the breakage of expensive hockey sticks.

In another aspect, the present invention can comprise is a shaft repair insert comprising two insertion portions and a spacer portion. The two insertion portions are adapted for insertion into a broken, hollow-shaft and can include features to promote adhesion with the hollow shaft such as adhesives, coatings, surface treatments, barbs and other appropriate means. The shaft repair insert can be manufactured of any of the materials commonly used in constructing hockey sticks and does not require the shaft repair insert use the same material used in constructing the hollow shaft. The shaft repair insert can be manufactured in a variety of cross-sectional configurations such that it can be successfully employed in shafts having a variety of cross-sections, for example rectangular, oval, triangular or other alternative geometric configurations and combination thereof.

In another aspect, the present invention comprises a shaft repair insert having two insertion ends. The two insertion ends are adapted for insertion into a broken, hollow-shaft and can include features to promote adhesion with the hollow shaft such as adhesives, surface treatments, barbs and other appropriate means. The shaft repair insert can be manufactured of any of the materials commonly used in constructing hockey sticks and does not require the shaft repair insert use the same material as used in constructing the hollow shaft. The shaft repair insert can be manufactured in a variety of cross-sectional configurations such that it can be successfully employed in shafts having a variety of cross-sections, for example rectangular, oval, triangular or other alternative geometric configurations and combinations thereof.

In another aspect, the present invention comprises a shaft repair insert having two insertion components and a joining component for repairing a broken hockey stick shaft. The tow insertion components can each comprise a throughbore or partial bore adapted for insertion such as through slidable or threadable insertion of the joining component. The shaft repair insert can further include an adhesive to promote interconnection between the insertion components and the joining component.

In another aspect, the present invention comprises methods of using the aforementioned shaft repair inserts to repair a hollow-shafted hockey stick or shaft.

In another aspect, the present invention comprises a shaft repair sleeve. The shaft repair sleeve can be adapted for placement over or around a hockey stick shaft, wherein two portions of a broken stick or shaft are operably interfaced and held together in an aligned relation. The shaft repair sleeve can be used to repair nicks, scratches and other defects prior to an actual stick fracture. The shaft repair sleeve can have a solid form with a hollow interior for slidable placement or the sleeve can take the form of sheet of a tape, a wrap, a sheet or a fabric of material such as, for example, woven or non-woven forms of composite and non-composite materials, that is wrapped around the interface between two portions of a stick shaft. The shaft repair sleeve, either in solid form or a wrap, can include means for promoting attachment to a hockey stick shaft such as, for example, adhesives, friction enhancers, coatings or other appropriate surface treatments. The shaft repair sleeve can be manufactured of any of the materials commonly used in constructing hockey sticks and does not require the shaft repair sleeve use the same material used in constructing the hockey stick shaft. When manufactured in a solid form, the shaft repair sleeve can be adapted to have a wide variety of cross-sectional configurations such that it can be successfully employed with stick shafts having a variety of cross-sections, for example rectangular, oval, triangular or other alternative geometric configurations and combinations thereof. The shaft repair sleeve can be manufactured of a heat sensitive or chemically activated material such that the sleeve can be "shrink-wrapped" around the hockey stick shaft to minimize the cross-section of the repaired hockey stick.

In another aspect, the present invention comprises methods of using the aforementioned shaft repair sleeves to repair a hollow-shafted hockey stick.

In another aspect, the present invention comprises methods of using the aforementioned shaft repair inserts in combination with the aforementioned shaft repair sleeves to repair a hollow shafted hockey stick.

In another aspect, the present invention comprises a blade receiving insert designed for repairing damage in a hollow shafted hockey stick that occurs at an insertion end where a replaceable blade is attached. The blade receiving insert can comprise an insertion portion and receiving portion. The insertion portion can comprise a male portion adapted for insertion into a hollow shaft and can include features to promote adhesion with the hollow shaft such as adhesives, surface treatments, barbs and other appropriate means. The insertion portion can be manufactured in a variety of cross-sectional configurations such that it can be successfully employed with stick shafts having a variety of cross-sectional configurations, for example rectangular, oval, triangular, or other alternative geometric configurations and combinations thereof. The receiving portion is adapted to receive a shank or hozel from a replaceable blade. The receiving portion can be manufactured in a variety of cross-sectional configurations such that it can be successfully employed with replaceable blades having shanks with a variety of cross-sectional configurations, for example rectangular, oval, triangular or other alternative geometric configurations and combinations thereof. The receiving portion can be configured so as to promote compatibility between shafts and replacement blades such as, for example, shafts and blades from differing manufacturers that were previously incompatible due to dimensional differences between the shaft cross-section and the blade shank cross-section. The blade receiving insert can further be used to increase or modify the overall length of the hockey stick shaft such as, for example, when a shaft repair requires the removal of a broken or fractured portion of the hockey stick shaft or when a user outgrows or wishes to change the performance, such as for example, flexibility, weight or durability, of the stick shaft. The blade receiving insert can be manufactured of any of the materials commonly used in constructing hockey sticks and does not require the blade receiving insert use the same material used in the construction of either the hollow shaft or the replaceable blade. In addition, the aforementioned repair sleeve can be used in conjunction with the blade receiving insert to further promote the attachment of the blade receiving insert and the hockey shaft.

In another aspect, the present invention comprises methods of using the aforementioned blade receiving insert to repair or modify a hollow shafted hockey stick.

In another aspect, the present invention can comprise a shaft repair insert or blade receiving insert in which an insert component and a self-hardening adhesive or expanding composition is used to facilitate connection of the insert to a hockey stick shaft portion.

BRIEF DESCRIPTION OF THE DRAWINGS

The invention can be more completely understood in consideration of the following detailed description of various embodiments of the invention in connection with the accompanying drawings.

FIG. 24*a* is a detailed, exploded, perspective view of the hockey stick of FIG. 24.

FIG. 29*a* is a partially hidden, perspective view of the hollow one-piece hockey stick of FIG. 29 including the blade receiving insert of FIG. 26.

Figure 1:
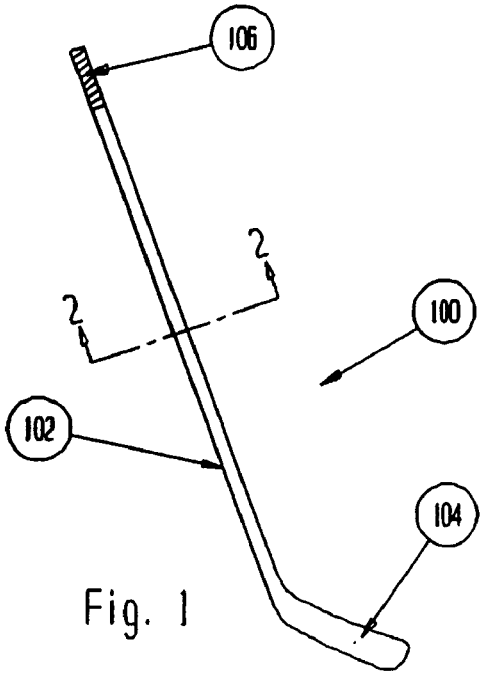
FIG. 1 is a side view of a hollow-shafted hockey stick.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF PREFERRED EMBODIMENTS

Figure 2:
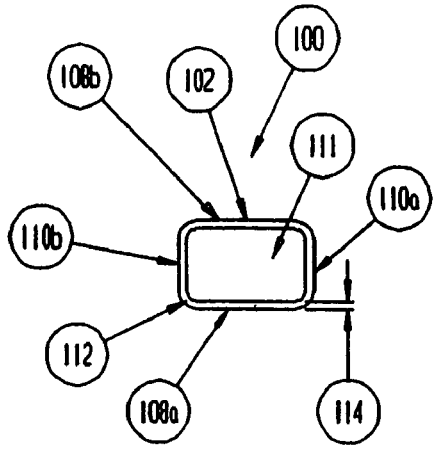
FIG. 2 is a section view of the hockey stick of FIG. 1 taken along line 2—2 of FIG. 1.

As depicted in FIG. 1, a hockey stick 100 is comprised of a shaft 102, a blade 104 and a gripping end 106. Hockey stick 100 can be manufactured from a variety of materials including wood, aluminum, titanium, fiberglass, Kevlar®, carbon-fiber, graphite, ABS, ceramics and other composite fibers and materials, either woven or non-woven, and either individually or in any combination thereof. As depicted in FIG. 2, shaft 102 can comprise a pair of elongated sides 108*a*, 108*b* and a pair of shortened sides 110*a*, 110*b* defining a hollow shaft interior 111. Each of the various sides is defined by a shaft wall 112 having a shaft wall thickness 114. Depending upon desired performance characteristics such as stick flex, stick weight and the like, shaft 102 can have varying profiles within a single shaft by varying dimensions such as, for example, varying dimensions for the elongated sides 108*a*, 108*b*, shortened sides 110*a*, 110 and wall thickness 114 through the shaft 102. Shaft 102 can be manufactured to include the hollow shaft interior 111 for a variety of reasons such as, for example, reducing overall stick weight and/or varying the puck handling or shooting characteristics of the hockey stick 100. Shaft 102 can be manufactured in a variety of sizes such as, for example, adult sizes, intermediate sizes, junior sizes and youth sizes. While the use of shafts 102 having hollow shaft interiors 111 can be advantageous, there are certain disadvantages as compared to the more traditional solid shafted hockey stick.

Figure 3:
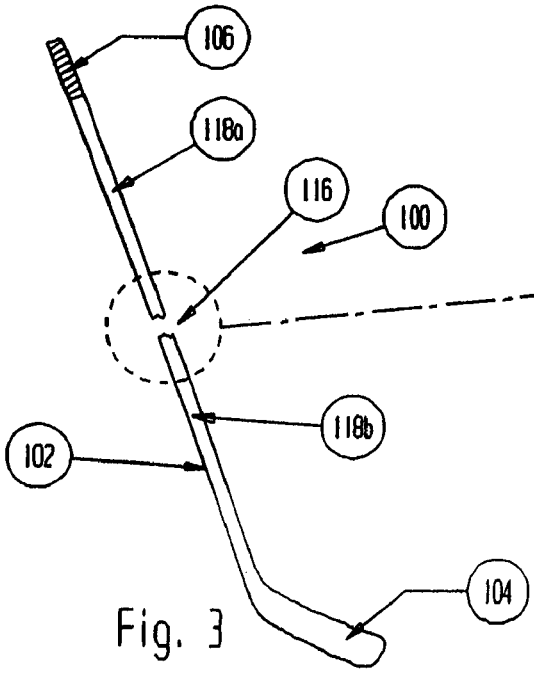
FIG. 3 is a side view of a hollow-shafted hockey stick with a broken shaft.
Figure 4:
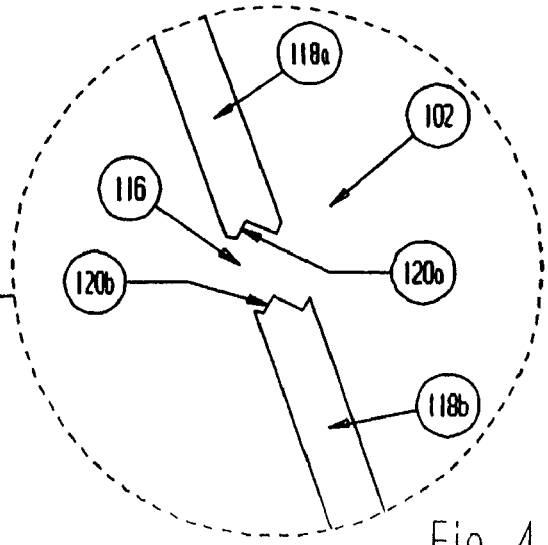
FIG. 4 is a detailed view of a fracture in the hockey stick of FIG. 3.
Figure 5:
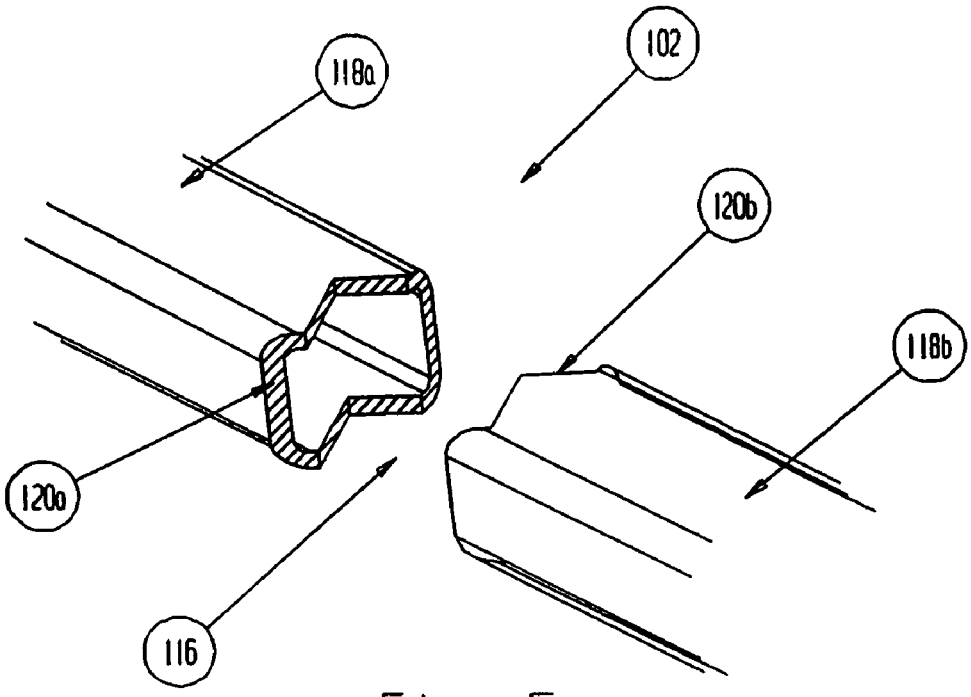
FIG. 5 is a perspective view of the fracture of FIG. 4.
Figure 6:
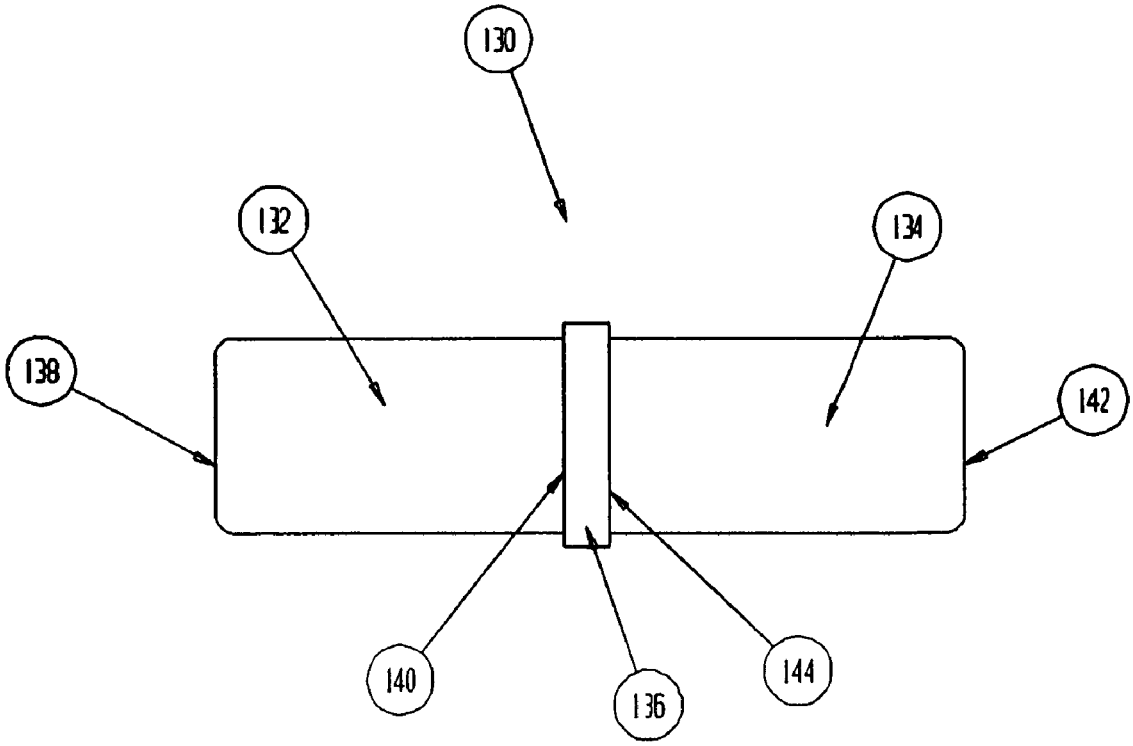
FIG. 6 is a side view of a an embodiment of a shaft repair insert.

One disadvantage of a shaft 102 that includes a hollow shaft interior 111 is that shaft 102 is subject to breaking along the length of shaft 102 as opposed to the more traditional breaking at the blade 104. As depicted in FIGS. 3, 4 and 5, hockey stick 100 has been broken as indicated at fracture 116 on shaft 102. Fracture 116 results in the formation of a top shaft portion 118*a* and a bottom shaft portion 118*b*. At fracture 116, top shaft portion 118*a* includes a top fracture surface 120*a* while bottom shaft portion 118*b* includes a bottom fracture surface 120*b*. The fracture surfaces 120*a*, 120*b* can be smooth, rough, jagged and/or uneven.

An embodiment of a shaft repair insert 130 of the present invention is depicted in FIGS. 6, 7, 8, 9 and 10. Shaft repair insert 130 comprises a first insertion portion 132, a second insertion portion 134 and a spacer portion 136. First insertion portion 132 extends from a first end 138 to a first flanged surface 140. Second insertion portion 134 extends from a second end 142 to a second flanged surface 144. Spacer portion 136 is defined between the first flanged surface 140 and the second flanged surface 144. Shaft repair insert 130 can be constructed of any material compatible with shaft 102, for example wood, aluminum, titanium, fiberglass, Kevlar®, a rigid polymer, carbon-fiber, graphite, ABS, ceramics and other composite fibers and materials, either woven or non-woven, and either individually or in any combination thereof. Preferably, the shaft repair insert 130 is comprised of a material capable of imparting similar stick characteristics as the material of which the shaft 102 is comprised.

Figure 7:
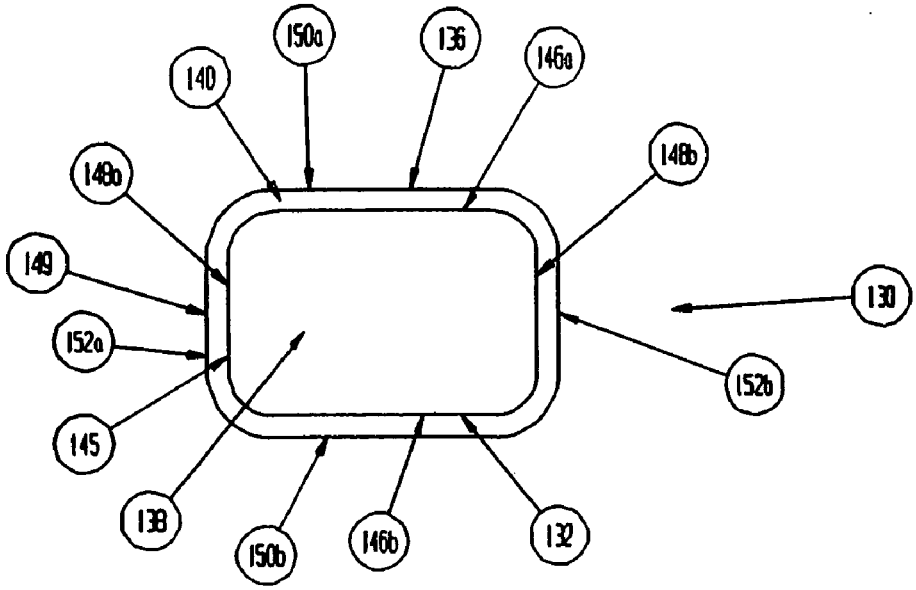
FIG. 7 is an end view of the shaft repair insert of FIG. 6.

First insertion portion 132 is further depicted in FIG. 7 as having a first perimeter surface 145 defined by a pair of first elongated sides 146*a*, 146*b* and a pair of first shortened sides 148*a*, 148*b*. Spacer portion 136 is also depicted in FIG. 7 as having a spacer perimeter surface 149 defined by a pair of spacer elongated sides 150*a*, 150*b* and a pair of spacer shortened sides 152*a*, 152*b*.

Figure 8:
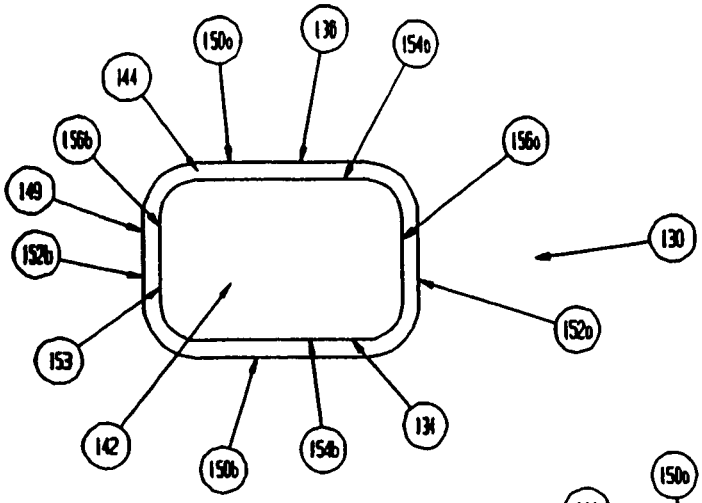
FIG. 8 is an end view of the shaft repair insert of FIG. 6.
Figure 8A:
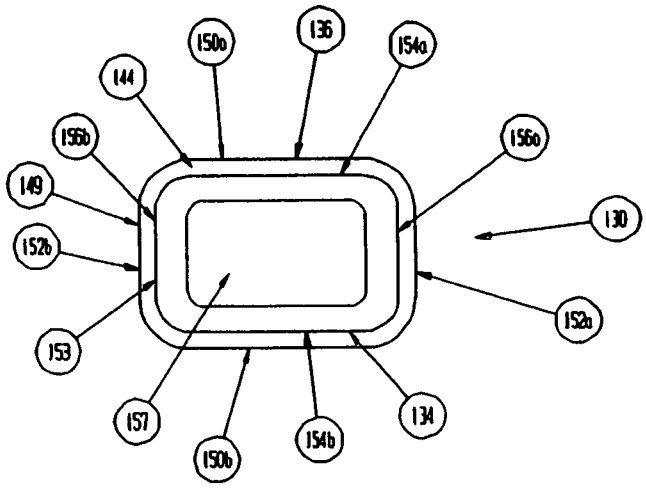
Figure 8B:
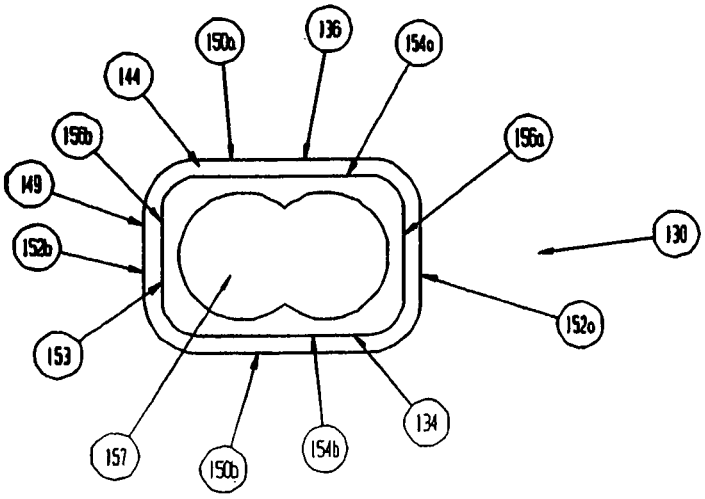

Second insertion portion 134 is further depicted in FIG. 8 as having a second perimeter surface 153 defined by a pair of second elongated sides 154*a*, 154*b* and a pair of second shortened sides 156*a*, 156*b*.

Figure 7A:
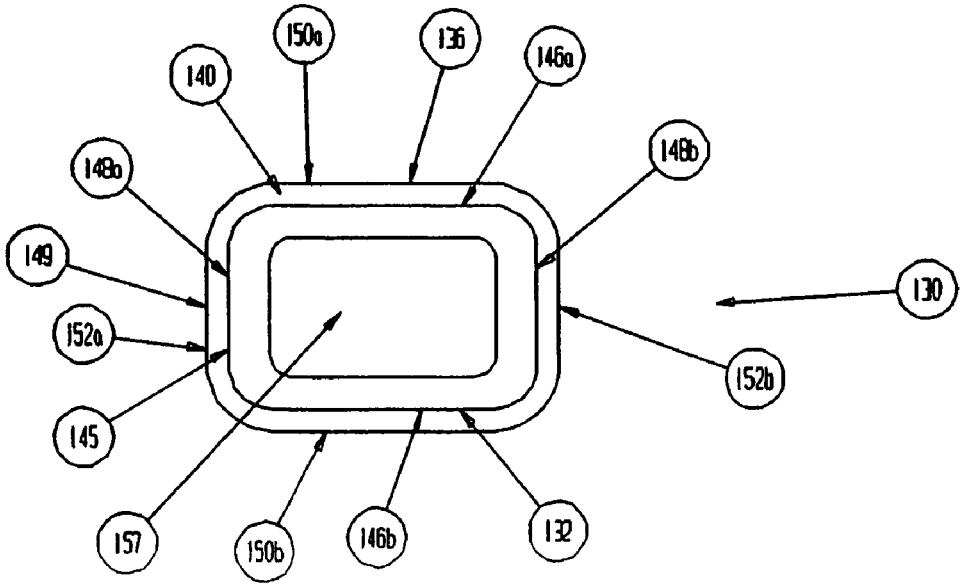
FIG. 7*a* is an end view of an alternative embodiment of a shaft repair insert.
Figure 7B:
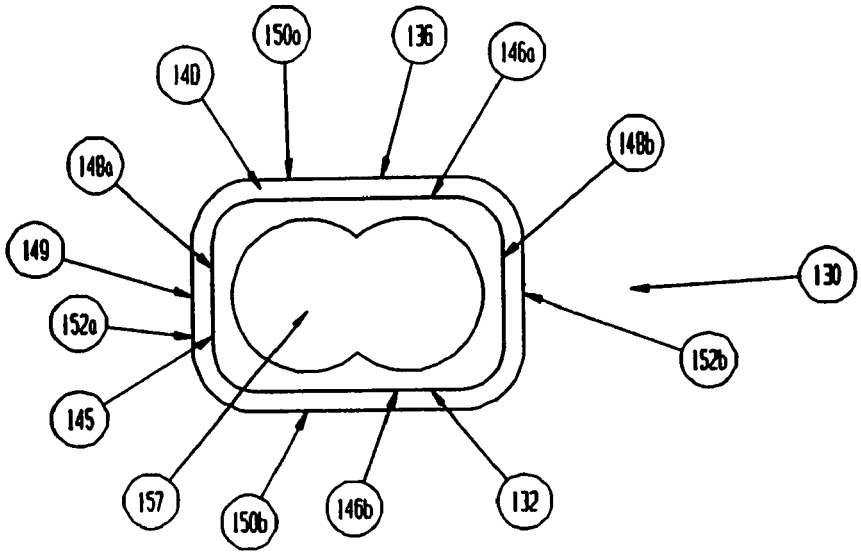
FIG. 7*b* is an end view of an alternative embodiment of a shaft repair insert.
Figure 10:
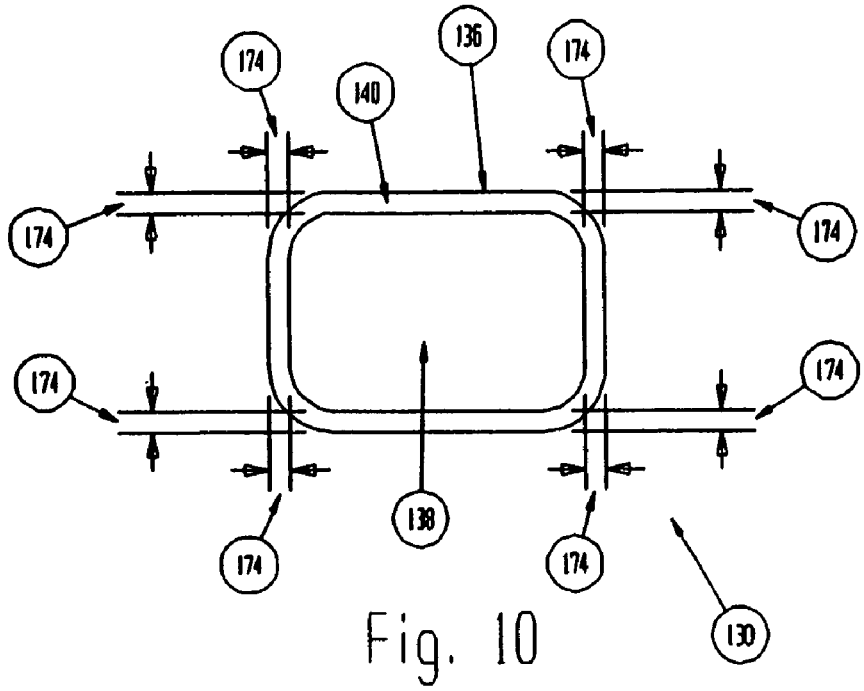
FIG. 10 is an end view of the shaft repair insert of FIG. 6.
Figure 11:
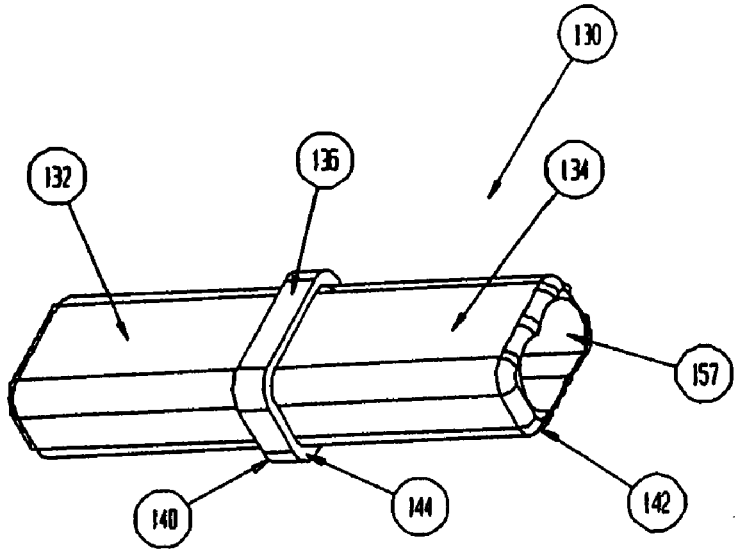
FIG. 11 is a perspective view of the shaft repair insert of FIG. 7*b*.

As depicted in FIGS. 7, 8 and 10, shaft repair insert 130 can comprise a solid member extending from the first end 138 to the second end 140. In alternative embodiments, shaft repair insert 130 can comprise a hollow interior 157 as shown in FIGS. 7*a*, 7*b*, and 11. Hollow interior 157 can be fabricated mechanically such as, for example, by drilling out the shaft repair insert as is illustrated in FIGS. 7*b* and 11. Alternatively, hollow interior 157 can be formed during fabrication of the shaft repair insert 130 such as, for example, during an extrusion, molding or weaving process or using a process similar to that employed in forming shaft 102. Hollow interior 157 can be partially hollow, for instance within the first insertion portion 132 and the second insertion portion 134 or completely hollow from the first end 138 to the second end 142. Hollow interior 157 serves to reduce the overall weight of the shaft repair insert 130 so as not to be a major contributor to overall stick weight.

Figure 7C:
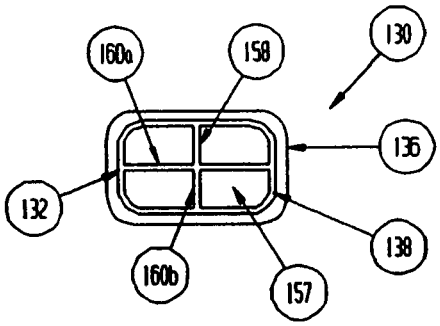
FIG. 7*c* is an end view of an alternative embodiment of a shaft repair insert.
Figure 7E:
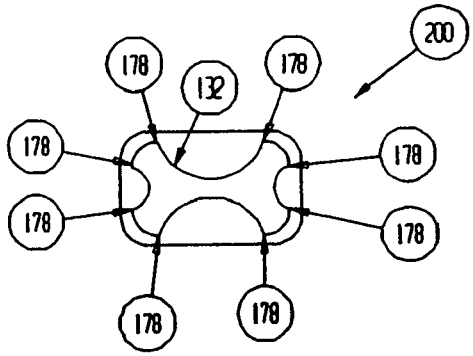
FIG. 7*e* is an end view of an alternative embodiment of a shaft repair insert.
Figure 7D:
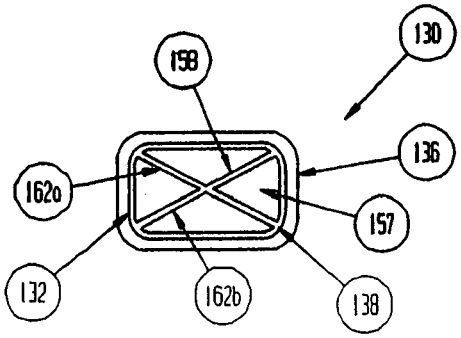
FIG. 7*d* is an end view of an alternative embodiment of a shaft repair insert.

In shaft repair inserts 130 that include either a partially or completely hollow interior 157, the shaft repair insert 130 can further comprise an internal reinforcement structure 158 within the hollow interior 157 as viewed from the first end 138 as shown in FIGS. 7*c* and 7*d*. Internal reinforcement structure 158 can comprise a horizontal member 160*a* and a vertical member 160*b* as shown in FIG. 7*c*. Internal reinforcement structure 158 can comprise a pair of diagonal members 162*a*, 162*b* as shown in FIG. 7*d*. It is to be understood that internal reinforcement structure 158 can further comprise variations combining horizontal member 160*a*, vertical member 160*b* and diagonal members 162*a*, 162*b* in a variety of alternative arrangements. The internal reinforcement structure 158 can extend either a partial or full length of shaft repair insert 130 between first end 138 and second end 142. Internal reinforcement structure 158 can provide the benefit or reduced weight associated with a hollow or partially hollow shaft repair insert 130 with increased strength being provided by the internal reinforcement structure 158.

Figure 9:
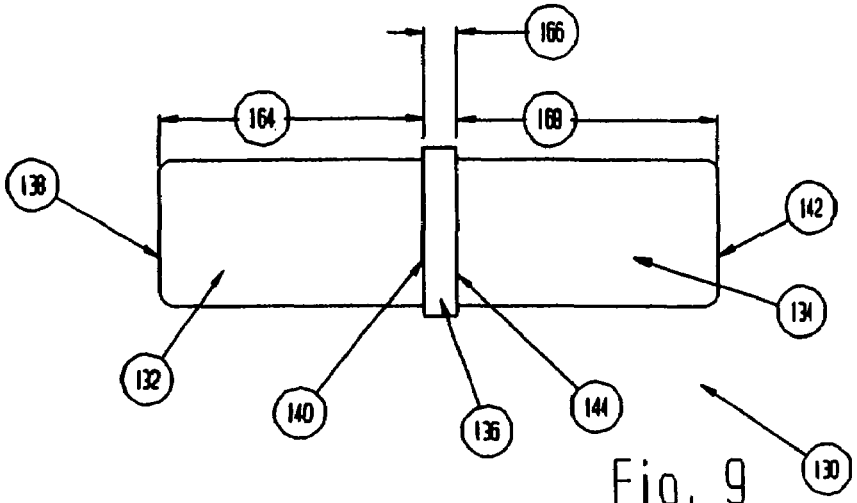
FIG. 9 is a side view of the shaft repair insert of FIG. 6.

As shown in FIG. 9, the first insertion portion 132 has a first insertion length 164 defined by the first end 138 and the first flanged surface 140. The spacer portion 136 has a spacer length 166 defined by first flanged surface 140 and the second flanged surface 144. The second insertion portion 134 has a second insertion length 168 defined by the second end 142 and the second flanged surface 140.

Figure 9B:
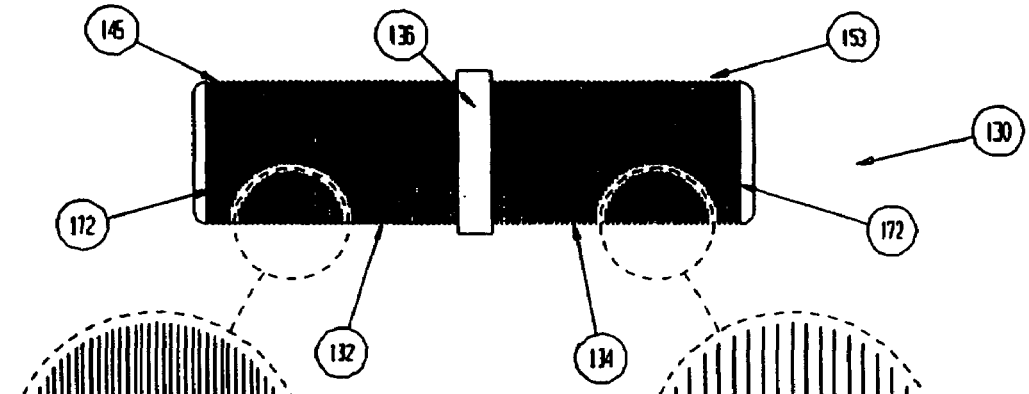
FIG. 9*b* is a side view of an embodiment of a shaft repair insert.
Figure 9C:
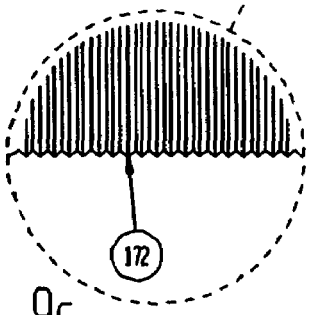
FIG. 9*c* is a detailed side view of the shaft repair insert of FIG. 9*b*.
Figure 9D:
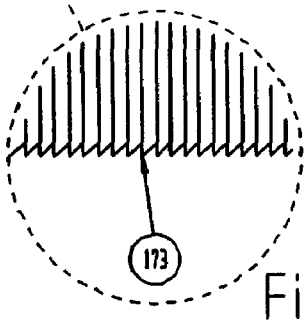
FIG. 9*d* is a detailed side view of the shaft repair insert of FIG. 9*b*.
Figure 9A:
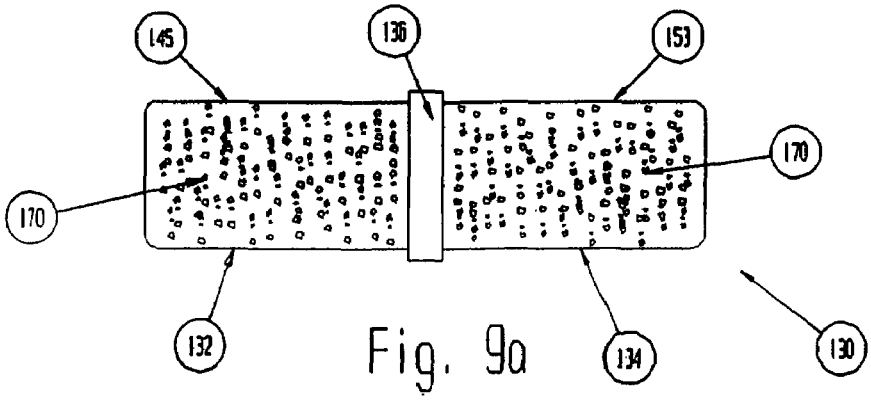
FIG. 9*a* is a side view of an embodiment of a shaft repair insert.

As depicted in FIG. 9*a*, first insertion portion 132 and second insertion portion 194 can further comprises an adhesive 170. Adhesive 170 can comprise any suitable liquid or solid adhesive such as, for example, chemically or heat activated adhesives, one-part or multi-part adhesives, glues, hot melt, urethanes, polyurethanes, epoxies, acrylics and the like. Adhesive 170 can be applied on the first perimeter surface 145 and the second perimeter surface 153. Alternatively, first insertion portion 132 and second insertion portion 134 can comprise a plurality of projections or ridges 172 as depicted in FIGS. 9*b*, 9*c* and 9*d*. Alternatively, the insertion portions can include other features promoting attachment such as a roughened surface, barbs, friction enhancers or similar features.

As depicted in FIG. 10, the spacer portion 136 when viewed from the first end 138 as shown, or alternatively the second end 142, the first flanged surface 140 and the second flanged surface 144 have a flange width 174 that is substantially equal around all four surfaces of the first insertion portion 132.

Figures 12, 12A:
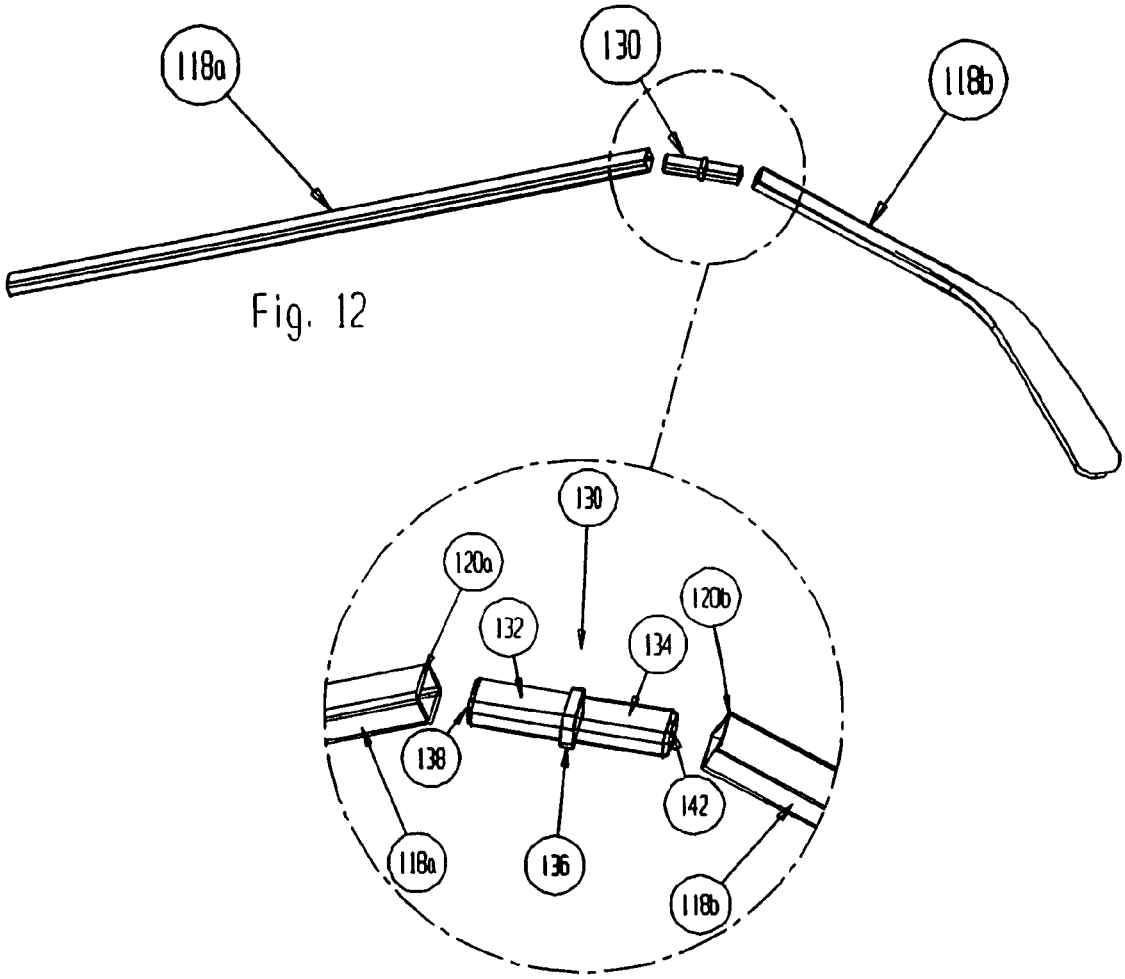
FIG. 12 is a side view of shaft repair insert of FIG. 6 prior to repairing the hockey stick of FIG. 3.
FIG. 12*a* is a detailed view of shaft repair insert of FIG. 6 prior to repairing the hockey stick of FIG. 3.

In use, shaft repair insert 130 is used to repair hollow shaft 102 that has been broken to form the top shaft portion 118*a* and the bottom shaft portion 118*b*. As depicted in FIG. 12, shaft repair insert 130 is positioned between the top shaft portion 118*a* and the bottom shaft portion 118*b* such that the first end 138 is facing the top fracture surface 120*a* while the second end 142 is facing the bottom fracture surface 120*b*. Throughout the description, it will be understood that the first insertion portion 132 and the second insertion portion 134 can be equivalently sized such that either insertion portion can be oriented toward either fracture surface. As depicted, top fracture surface 120*a* and bottom fracture surface 120*b* have been prepared for example, by sanding or sawing, to remove any irregularities in the shaft 102 caused by fracture 116 and to provide relatively smooth surfaces that are substantially perpendicular to the longitudinal axis of the shaft 102.

Figures 13, 13A:
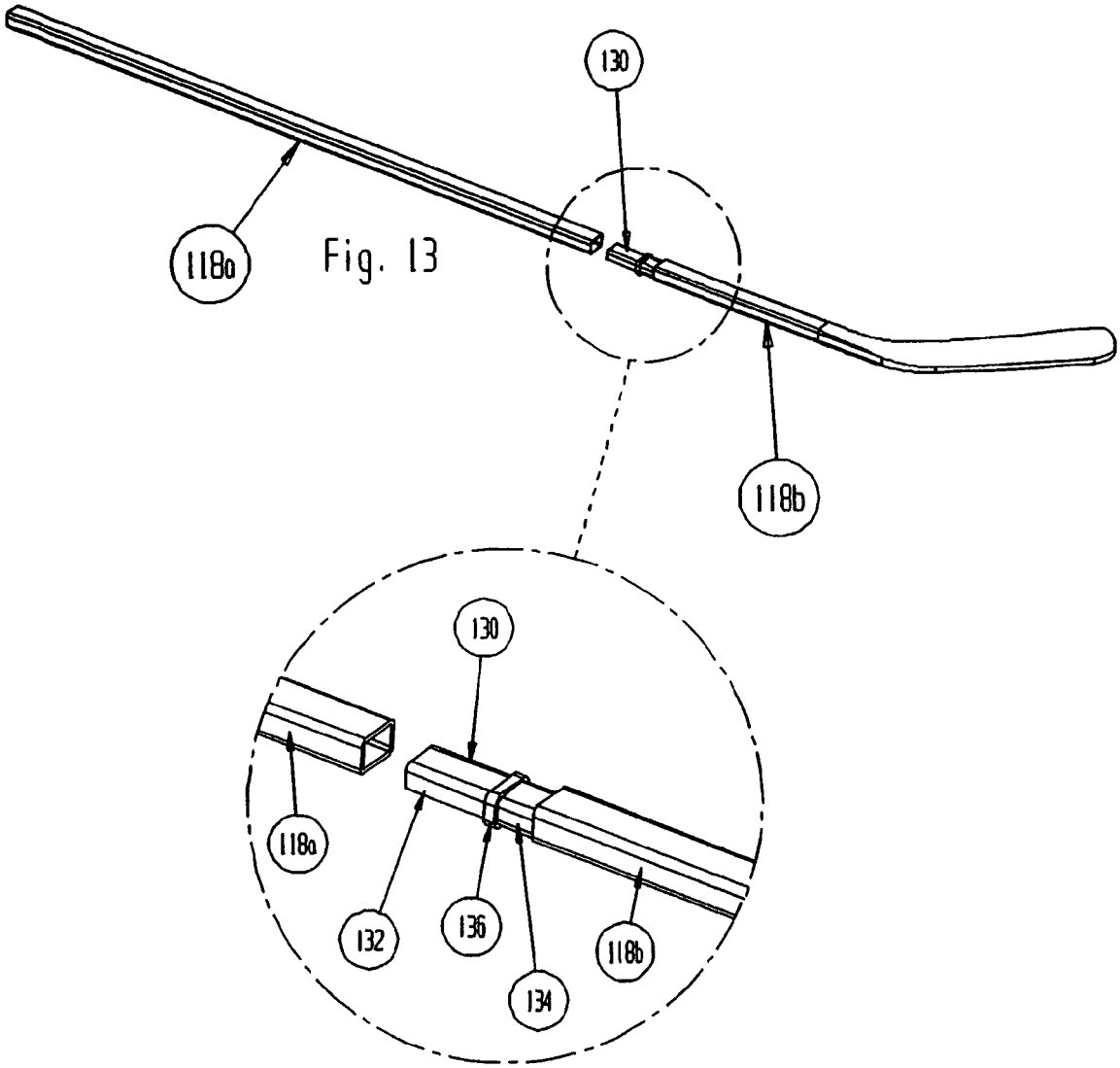
FIG. 13 is a side view of the shaft repair insert of FIG. 6 partially inserted in the hockey stick of FIG. 3.
FIG. 13*a* is a side view of the shaft repair insert of FIG. 6 partially inserted in the hockey stick of FIG. 3.
Figure 14:
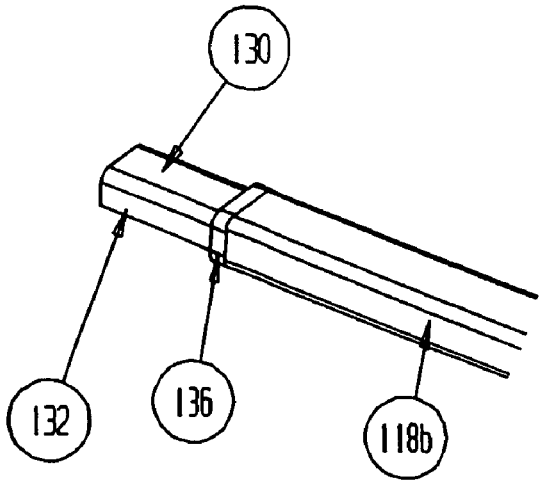
FIG. 14 is a side view of the shaft repair insert of FIG. 6 partially inserted in the hockey stick of FIG. 3.

Next, as shown in FIG. 13, the second end 142 is positioned with respect to the bottom shaft portion 118*b* such that the second insertion portion is slidingly inserted into the hollow shaft interior 111. Second perimeter surface 153 is similarly shaped in comparison to hollow shaft interior 111. As shown in FIG. 14, the second insertion portion 134 is fully inserted until the bottom fracture surface 120*b* is in contact with the second flanged surface 144. In addition, flange width 174 is substantially equivalent to the wall thickness 114 such that the spacer portion 136 has the same exterior dimensions as the bottom shaft portion 1118*b*.

Figure 15:
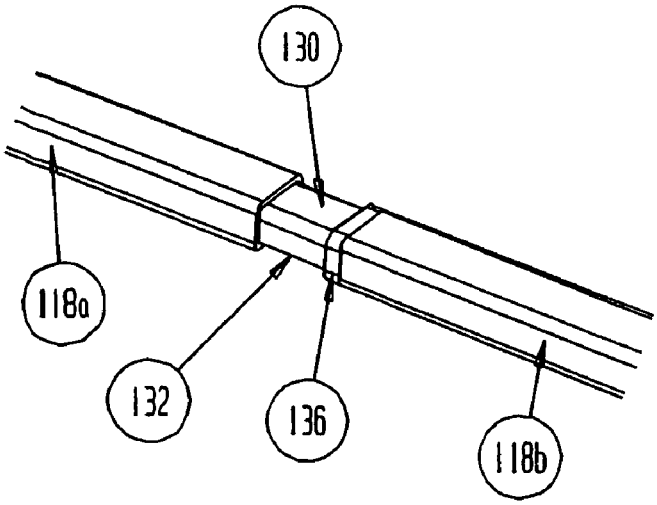
FIG. 15 is a side view of the shaft repair insert of FIG. 6 partially inserted in the hockey stick of FIG. 3.

After the second insertion portion 134 is fully inserted within the bottom shaft portion 118*b*, the first end 138 is positioned with respect to the top fracture surface 120*a* such that the first insertion portion 132 can be slidingly inserted into the top shaft portion 118*a* as shown in FIG. 15. First insertion portion 132 is fully inserted into the top shaft portion 118*a* until the first flanged surface 140 comes into contact with the top fracture surface 120*a*. As the flange width 174 is substantially equivalent to the wall thickness 114, the spacer portion 136 has substantially the same exterior dimension as the top shaft portion 118*a* and bottom shaft portion 118*b* such that there is virtually no dimensional difference between the shaft portions 118*a*, 118*b* and the spacer portion 136. In addition, shaft repair insert 130 can be manufactured such that spacer portion 136 has an exterior color such as, for example, the same exterior color as shaft 102 so as to make the repair essentially invisible or space portion may comprise any other visually desirable color. Spacer portion 136 can also comprise an exterior treatment such as, for example a roughed or rubberized exterior surface to enhance grip or to match similar exterior characteristics of the shaft 102.

Figures 16, 16A:
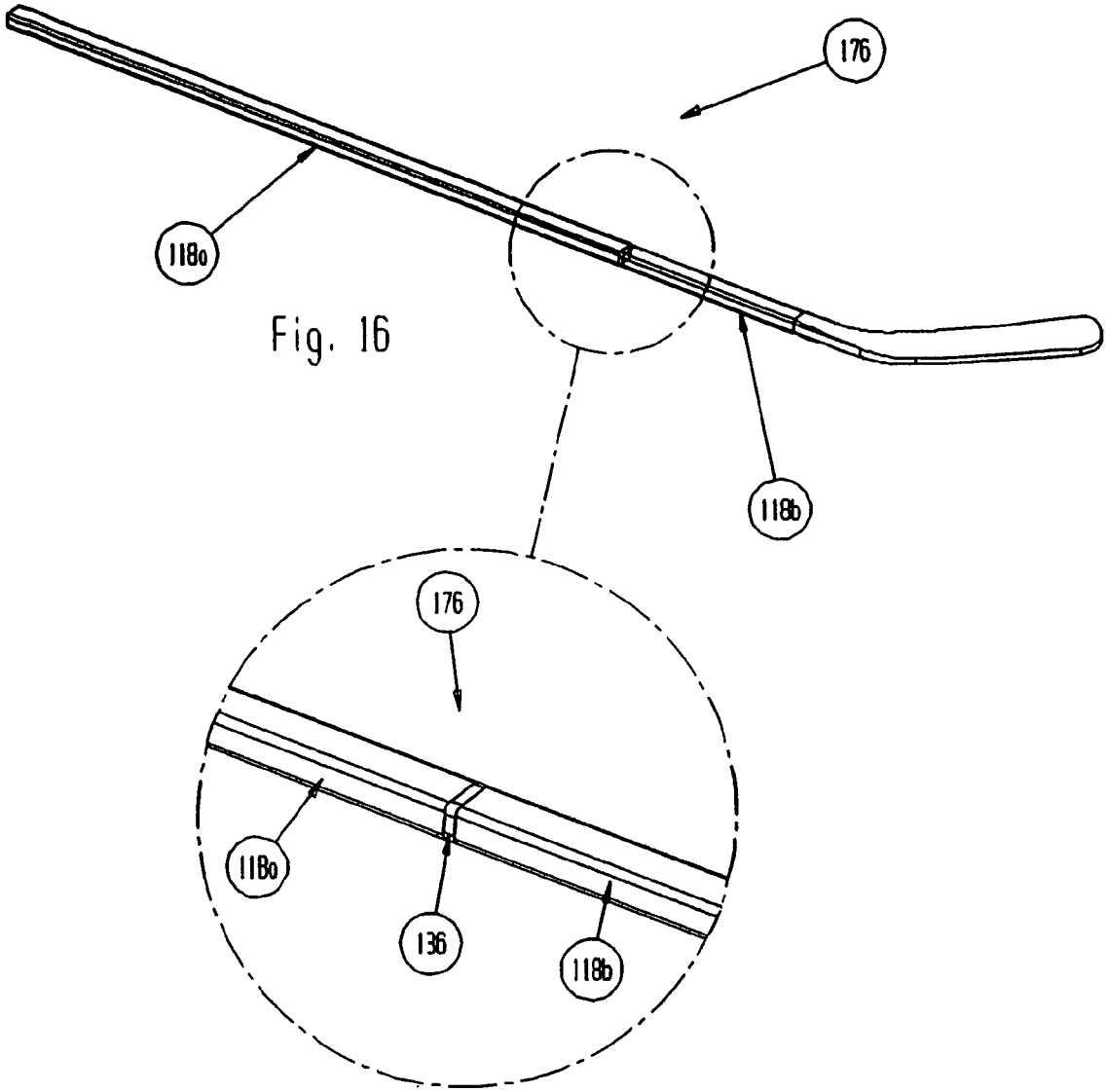
FIG. 16 is a side view of the hockey stick of FIG. 3 repaired with the shaft repair insert of FIG. 6.
FIG. 16*a* is a detailed side view of the hockey stick of FIG. 3 repaired with the shaft repair insert of FIG. 6.

Prior to joining the top shaft portion 118*a* and bottom shaft portion 118*b*, a user can activate or apply the adhesive 170 so as to permanently and fixedly position the shaft repair insert 130. A user can, for example, use a hair dryer or other suitable heat source to activate a heat activated adhesive. Alternatively, the user can mix two chemical components such as, for example, a two-part epoxy, and spread the adhesive 170 on the first insertion portion 132 and second insertion portion 134 prior to joining the top shaft portion 118*a* and bottom shaft portion 118*b* with the shaft repair insert 130 to form a repaired shaft 176 shown in FIG. 16. The insert portions can comprise other attachment means such as, for example ridges 172, barbs, O-rings and other similar features to further promote attachment between the shaft repair insert 130 and the shaft portions. In addition, a user can wrap a layer of tape over the spacer portion 136 to cover any fraying or fracture defects present in either the top shaft portion 118*a* or the bottom shaft portion 118*b*.

As depicted, the cross-sections of shaft 102 and shaft repair insert 130 are generally depicted as a rectangular shape. In alternative embodiments, the shaft 102 and correspondingly the shaft repair insert 130 can take other forms typically used with hockey sticks such as, for example oval, triangular or other geometrical configurations and combinations thereof. In one representative embodiment as shown in FIG. 7*e*, shaft repair insert 130 can comprise a first insertion portion 132 having a cross-section such that a plurality of contact points 178 come into contact with the shaft wall 112 when the shaft repair insert 130 is positioned with respect to the shaft 102. Contact points 178 can help to snugly retain the shaft repair insert 130 while allowing for a weight reduction similar to hollow or partially hollow shaft inserts.

Figure 17E:
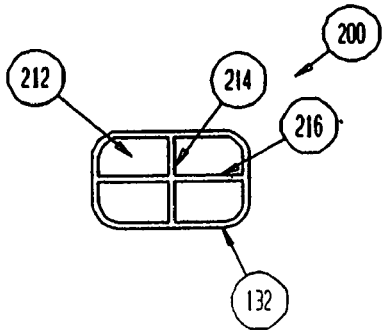
FIG. 17 is a perspective view of an alternative embodiment of a shaft repair insert.
FIG. 17*a* is an end view of an alternative embodiment of a shaft repair insert.
FIG. 17*b* is a perspective view of the shaft repair insert of FIG. 17*a*.
FIG. 17*c* is an end view of an alternative embodiment of a shaft repair insert.
FIG. 17*d* is a perspective view of the shaft repair insert of FIG. 17*c*.
Figure 17:
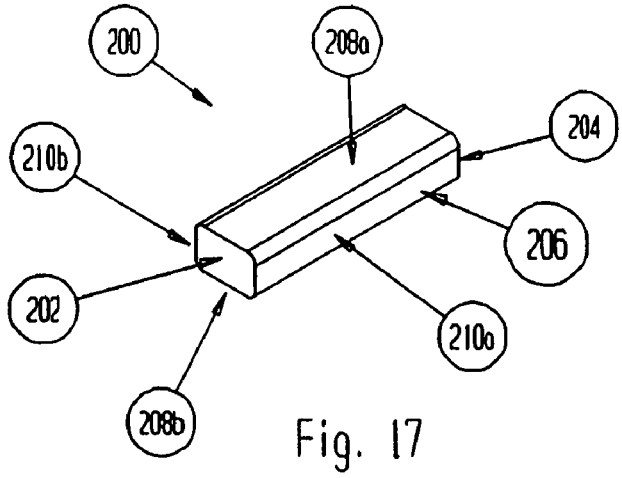
Figure 17F:
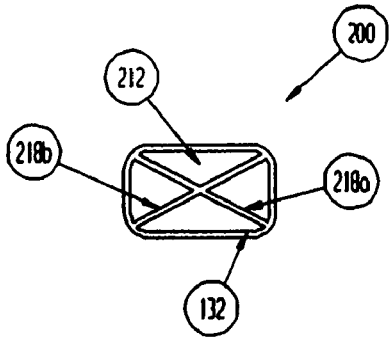
Figure 17A:
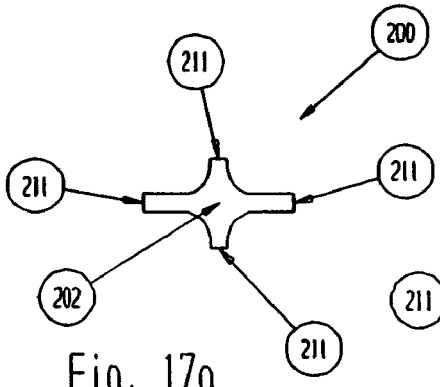
Figure 17B:
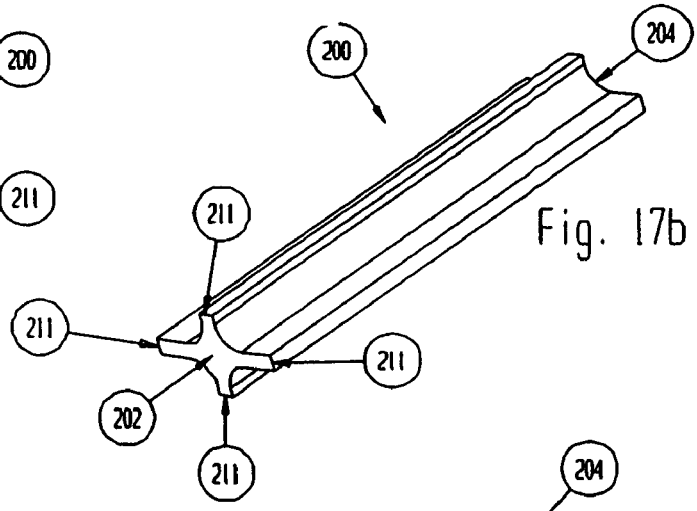
Figure 17C:
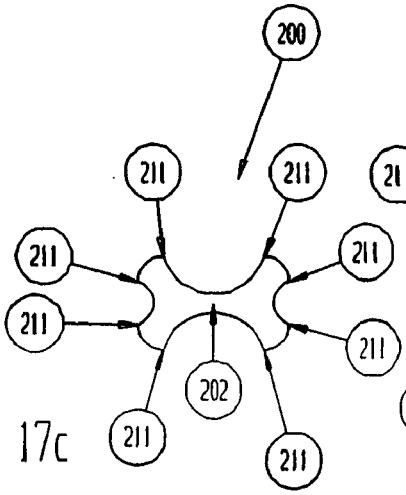
Figure 17D:
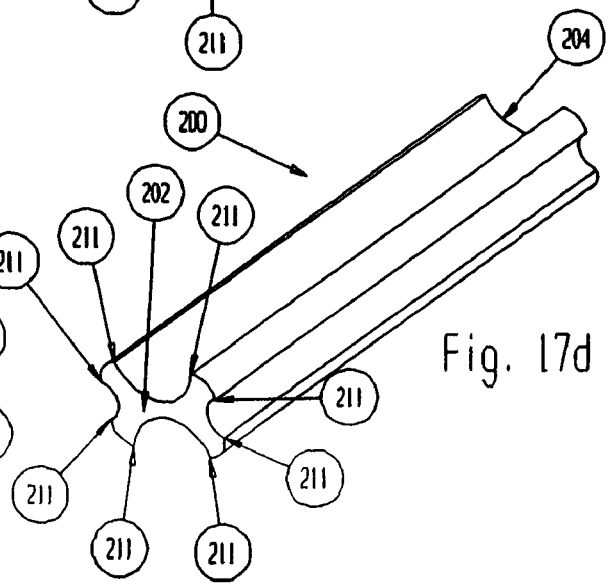

An alternative embodiment of a shaft repair insert 200 is depicted in FIG. 17. Shaft repair insert 200 has a first insertion end 202 and a second insertion end 204. Shaft repair insert 200 has an insert cross-sectional perimeter 206 defined by a pair of elongated sides 208*a*, 208*b* and a pair of shortened sides 210*a*, 210*b*. As depicted, perimeter 206 is rectangular. Alternative cross-sectional perimeters are possible and can include forms associated with hockey stick shafts such as ovals, triangles, or other geometrical configurations and combinations thereof. Other representative embodiments of shaft repair insert 200 are illustrated in FIGS. 17*a*, 17*b*, 17*c* and 17*d* and can include a plurality of contact points 211 to contact the shaft wall 112 when the shaft repair insert 200 is positioned with respect to the shaft 102. Elongated sides 208*a*, 208*b* and shortened sides 210*a*, 210*b* can include, either individually or in combination, a solid or liquid adhesive, such as, for example, chemically or heat activated adhesives, one-part or multi-part adhesives, glues, hot melt, urethanes, polyurethanes, epoxies, acrylics and the like or alternative surface treatments, such as for example compressible ridges, a roughened surface, barbs, O-rings, friction enhancers or similar features. Shaft repair insert 200 can be constructed of any material compatible with shaft 102, for example wood, aluminum, titanium, fiberglass, Kevlar®, a rigid polymer, carbon-fiber, graphite, ABS, ceramics and other composite fibers and materials, either woven or non-woven, and either individually or in any combination thereof. Preferably, the shaft repair insert 200 is comprised of a material capable of imparting similar stick characteristics as the material of which the shaft 102 is comprised. As previously depicted, shaft repair insert 200 is solid from first insertion end 202 to second insertion end 204. Alternatively, shaft repair insert 200 can comprise a partially or totally hollow interior 212 as illustrated in FIGS. 17*e* and 17*f*. As shown in FIG. 17*e*, shaft repair insert 200 can comprise a vertical support member 214 and a horizontal support member 216. As shown in FIG. 17*f*, shaft repair insert 200 can comprise a pair of diagonal support members 218*a*, 218*b*.

Figure 18:
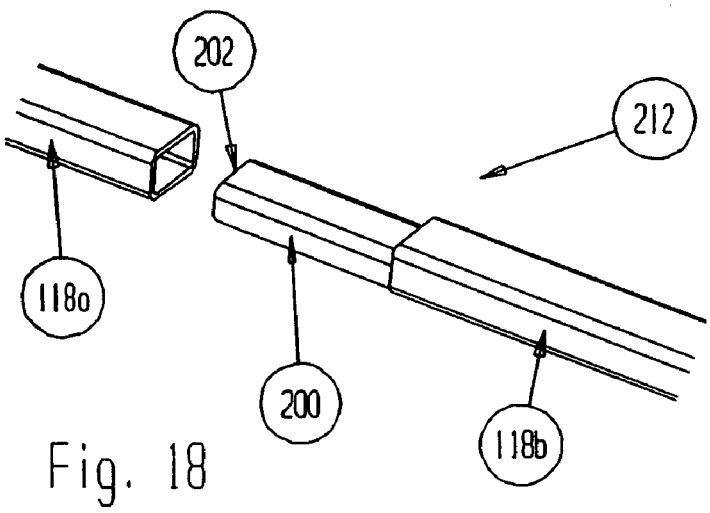
FIG. 18 is a side view of the shaft repair insert of FIG. 17 partially inserted in the hockey stick of FIG. 3.
Figure 18A:
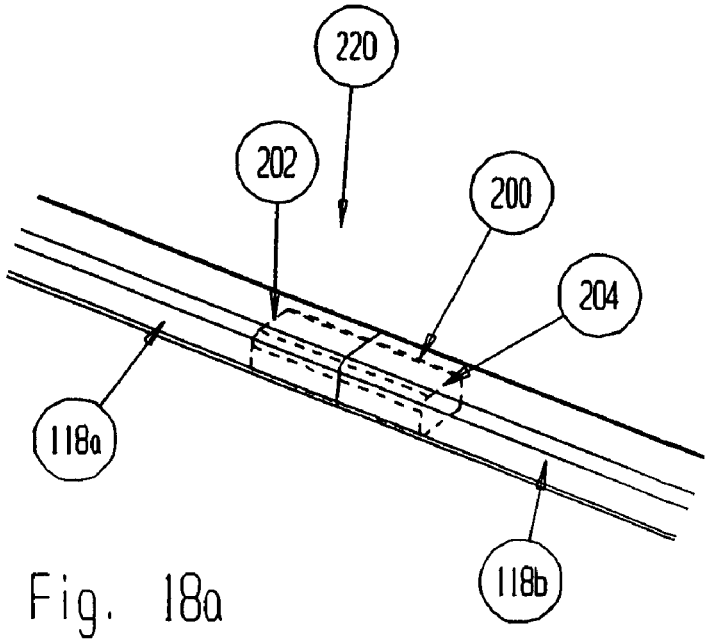
FIG. 18*a* is a side, partially hidden view of the shaft repair insert of FIG. 17 fully inserted in the hockey stick of FIG. 3.

Shaft repair insert 200 can be used to repair a broken hockey shaft 102 in a similar manner as that previously described with respect to shaft repair insert 130. If shaft repair insert 200 includes an adhesive, the adhesive can be applied or activated such as, for example, chemically by mixing components such as in a two-part epoxy or heat activated using a hair dryer or other suitable heat source to prepare the adhesive for use. As shaft repair insert 200 does not include a spacer portion 136, second insertion end 204 is slidingly inserted into the bottom shaft portion 118*b* such that approximately half of the shaft repair insert 200 is within the bottom shaft portion 118*b*, as shown in FIG. 18*a*. Next the first insertion end 202 is slidingly inserted into the top shaft portion 118*a* such that top shaft portion 118*a* and bottom shaft portion 118*b* are in contact, as shown in FIG. 18, to form a repaired shaft 220. In addition, a user can wrap a layer of tape over the abutment of the top shaft portion 118*a* and bottom shaft portion 118*b* to cover any fraying or fracture defects present in either the top shaft portion 118*a* or the bottom shaft portion 118*b*.

Figure 19:
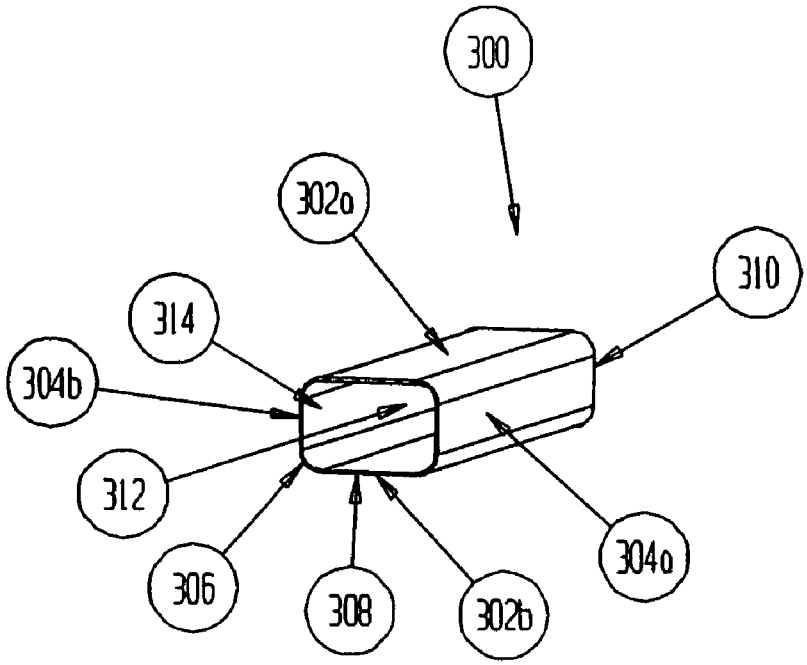
FIG. 19 is a perspective view of an embodiment of a shaft repair sleeve.
Figure 20:
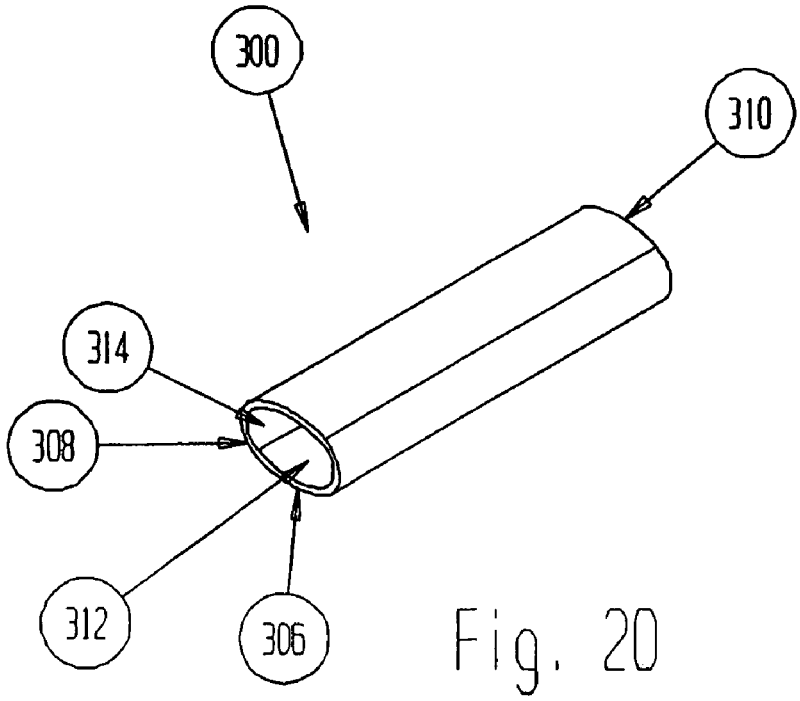
FIG. 20 is a perspective view of an embodiment of a shaft repair sleeve.

In another embodiment of the present invention, a shaft repair sleeve 300 can be used to repair a hockey stick shaft 102 that has been broken into top shaft portion 118*a* and bottom shaft portion 118*b*. As depicted in FIG. 19, shaft repair sleeve 300 comprises a pair of elongated sides 302*a*, 302*b* and a pair of shortened sides 304*a*, 304*b*. Elongated sides 302*a*, 302*b* and shortened sides 304*a*, 304*b* define a sleeve perimeter cross-section 306, herein depicted as being rectangular. Alternatively, perimeter cross-section 306 can include forms associated with hockey stick shafts such as ovals, as shown in FIG. 20, or triangles and other geometrical configurations and combinations thereof. As depicted, shaft repair sleeve 300 has a first sleeve end 308 and a second sleeve end 310. Shaft repair sleeve 300 has a hollow interior 312 extending from first sleeve end 308 to second sleeve end 310. Hollow interior 312 is defined by an interior perimeter surface 314. Interior perimeter surface 314 can include attachment promoting means such as, for example, solid and liquid adhesives such as, for example, chemically or heat activated adhesives, one-part or multi-part adhesives, glues, hot melt, urethanes, polyurethanes, epoxies, acrylics and the like or alterative attachment promoting means such as, for example, compressible ridges, a roughened surface, barbs, O-rings or similar features. Shaft repair sleeve 300 can be constructed of any material compatible with shaft 102, for example wood, aluminum, titanium, fiberglass, Kevlar®, a rigid polymer, carbon-fiber, graphite, ABS, ceramics and other composite fibers and materials, either woven or non-woven, and either individually or in any combination thereof. Preferably, the shaft repair sleeve 300 is comprised of a material capable of imparting similar stick characteristics as the material of which the shaft 102 is comprised. In one representative embodiment, shaft repair sleeve 300 is fabricated using a continuous extrusion process. Alternatively, shaft repair sleeve 300 can be fabricated using molding, machining or similar fabrication methods as employed in manufacturing shaft 102.

Figure 21:
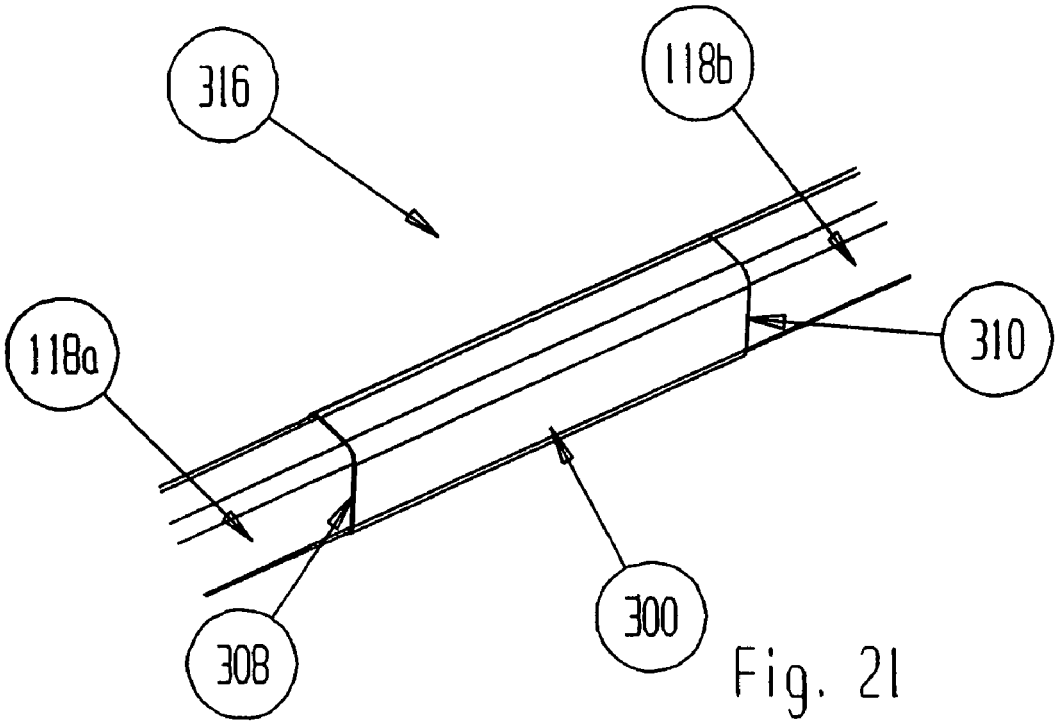
FIG. 21 is a side view of a repaired hockey shaft using the shaft repair sleeve of FIG. 19.
Figure 22:
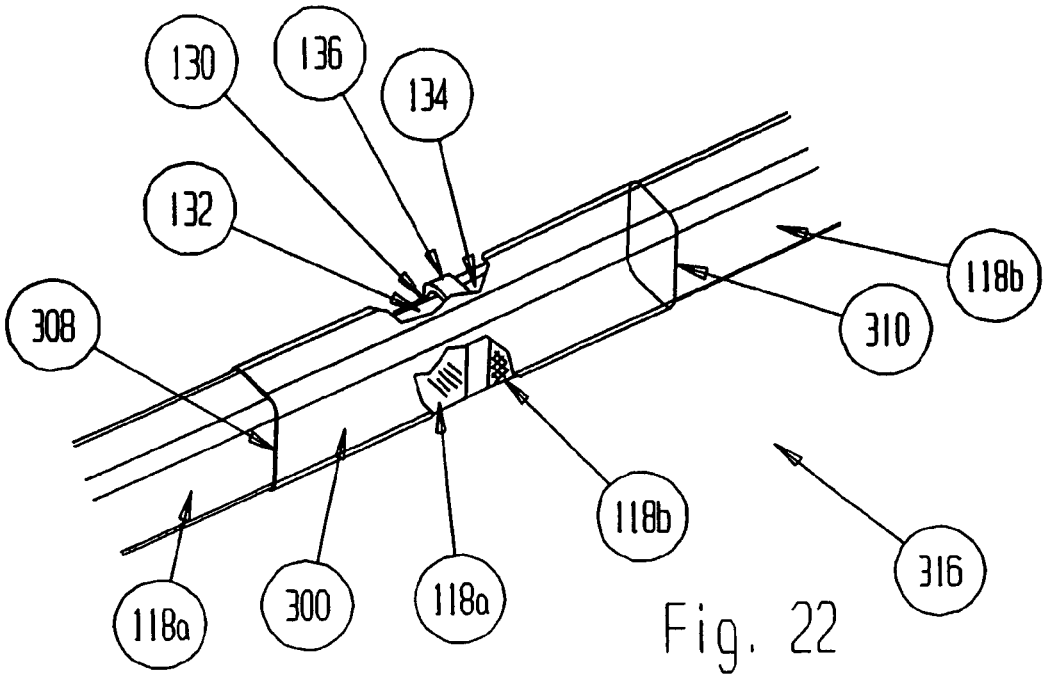
FIG. 22 is a side view of a repaired hockey shaft using the shaft repair sleeve of FIG. 19.
Figure 23:
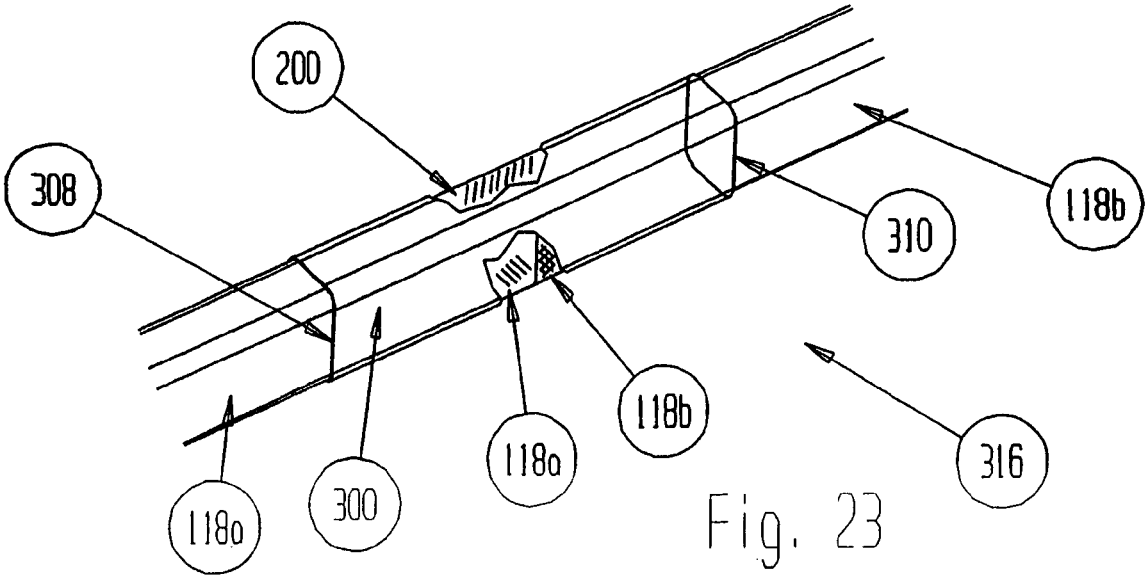
FIG. 23 is a side, partially hidden view of a repaired hockey shaft using the shaft repair sleeve of FIG. 19 and the shaft repair insert of FIG. 17.

Shaft repair sleeve 300 can be used to repair a broken hockey shaft 102, either alone as depicted in FIG. 21, or in combination with shaft repair insert 130 as depicted in FIG. 22 or shaft repair insert 200 as depicted in FIG. 23. First, the user approximates the top shaft portion 118*a* and bottom shaft portion 118*b*. This approximation can be accomplished using the methods associated with shaft repair insert 130 or shaft repair insert 200 as previously described, or can mean approximating and aligning them without an insert. Shaft repair sleeve 300 can be positioned over the interface of top shaft portion 118*a* and bottom shaft portion 118*b* as hollow interior 312 is designed to be slightly larger than the outside perimeter of shaft 102. Prior to placing the shaft repair sleeve 300 over top shaft portion 118*a* and bottom shaft portion 118*b*, adhesive can be activated or applied on interior perimeter surface 314. Activation of the adhesive can be accomplished in any suitable manner such as, for example, chemically through mixing such as a two-part epoxy or heat activation wherein a heat source activates the adhesive. Shaft repair sleeve 300 is positioned such that approximately half of the repair sleeve 300 resides over the top shaft portion 118*a* and half over the bottom shaft portion 118*b*. In one embodiment, repair sleeve 300 can be constructed of a heat sensitive material such that a heat source simultaneously activates the heat activated adhesive while causing the repair sleeve 300 to shrink-wrap around the interface between the top shaft portion 118*a* and bottom shaft portion 118*b* to minimize the protrusion of the repair sleeve 300 about a repaired shaft 316.

Figure 21A:
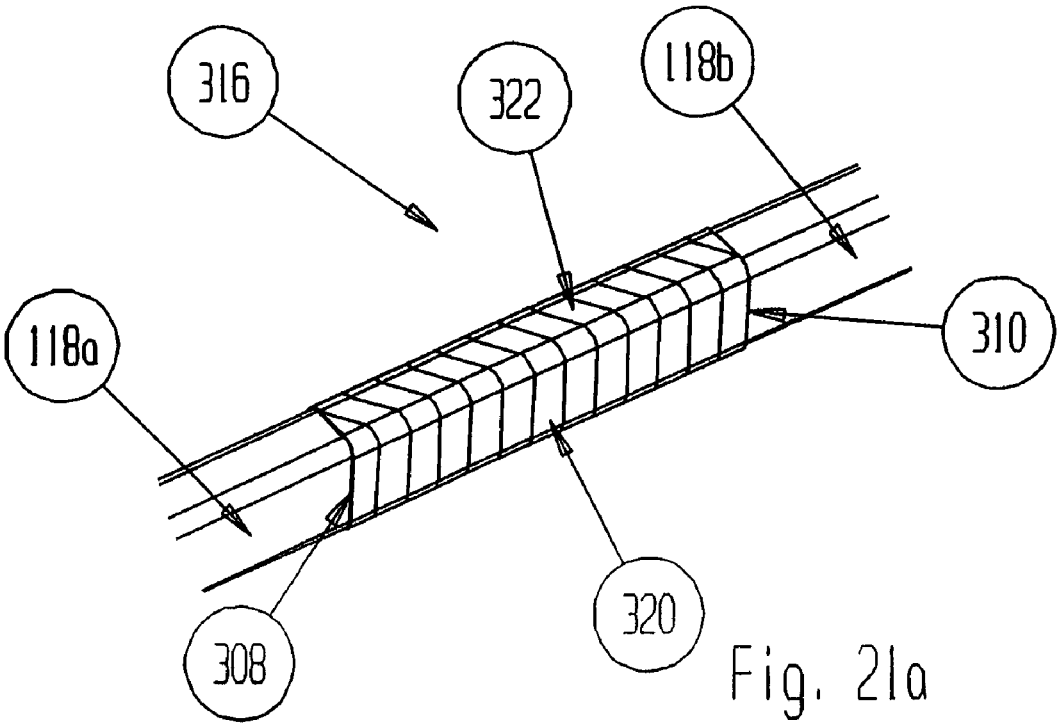
FIG. 21*a* is a side view of a repaired hockey shaft using an alternative embodiment of a shaft repair sleeve.
Figure 23A:
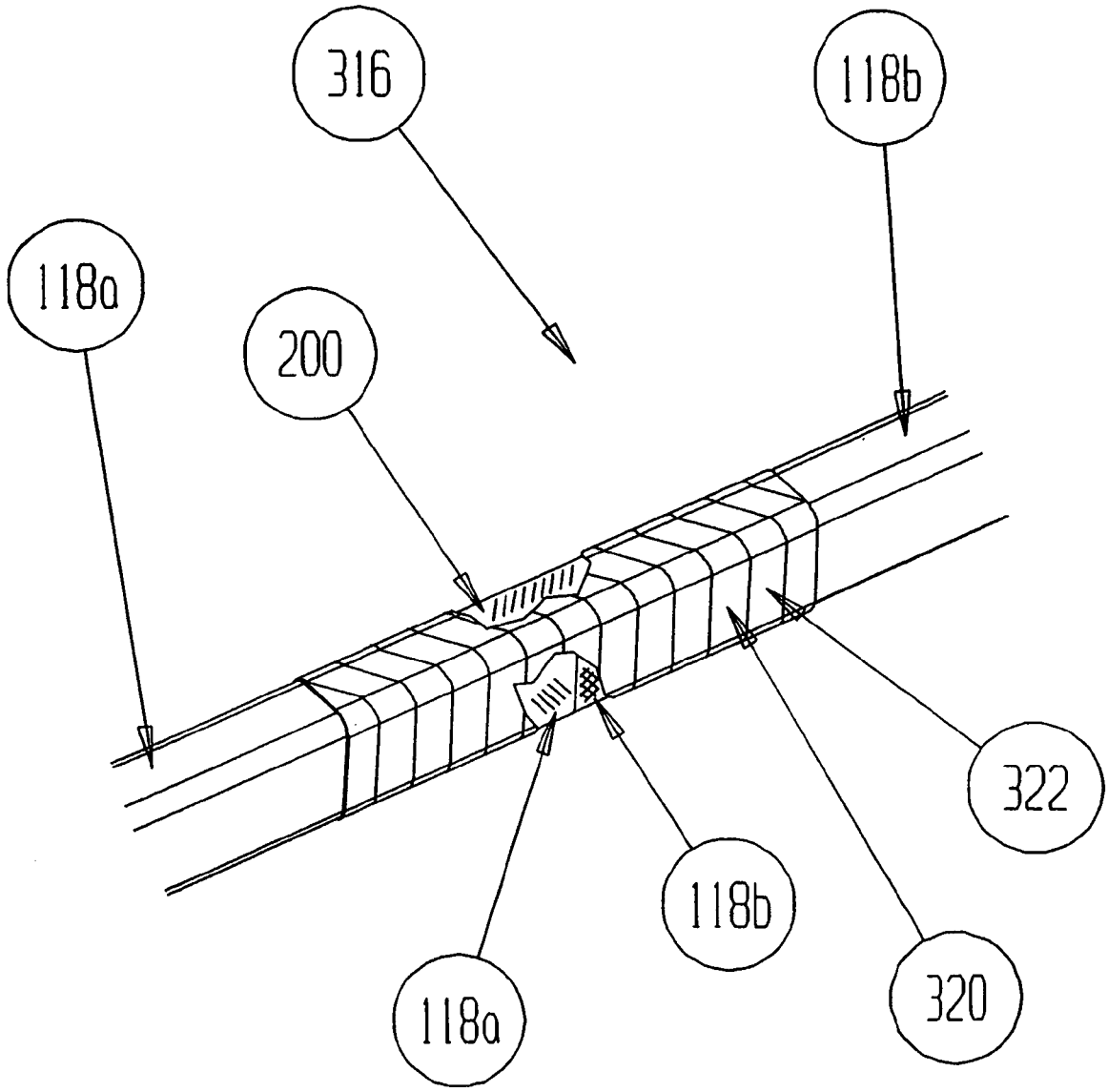
FIG. 23*a* is a partially hidden, perspective view of a repaired hockey shaft using the shaft repair sleeve of FIG. 21*a* and the shaft repair insert of FIG. 17.

In another representative embodiment, a repair sleeve 320 can take the form of a continuous tape 322 or sheet of material, fabric or composite fabric that is wrapped over the abutment of the top shaft portion 118*a* and the bottom shaft portion 118*b* as shown in FIG. 21*a*. Continuous tape 322 can be fabricated of suitable materials such as, for example, fiberglass, Kevlar®, graphite, carbon fiber as well as other woven and non-woven composite materials that are compatible with shaft 102. Continuous tape 322 can comprise an adhesive such as for example, an impregnated adhesive or adhesive on a joining surface to retain the wrapped position of the repair sleeve 320. Alternatively, an adhesive or coating such as, for example, a chemically or heat activated adhesive, can be placed on the top shaft portion 118*a* and bottom shaft portion 118*b* prior to wrapping the continuous tape 322 over the shaft 102 or alternatively, the adhesive or a suitable coating can be applied over the continuous tape 322 after it has been wrapped over the abutment of the top shaft portion 118*a* and bottom shaft portion 118*b*. Suitable adhesives or coatings can comprise chemically or heat activated adhesives, one-part or multi-part adhesives, glues, hot melt, urethanes, polyurethanes, epoxies, acrylics and the like. The repair sleeve 320 can be fabricated of a heat sensitive material allowing the repair sleeve 320 to be shrink-wrapped and fused following placement of the repair sleeve 320 over the interface between the top shaft portion 118*a* and bottom shaft portion 118*b*. Repair sleeve 320 can be used in conjunction with a shaft repair insert such as, for example, shaft repair insert 200 as shown in FIG. 23*a* to form a stick shaft repair assembly.

Figures 24, 24B, 24C:
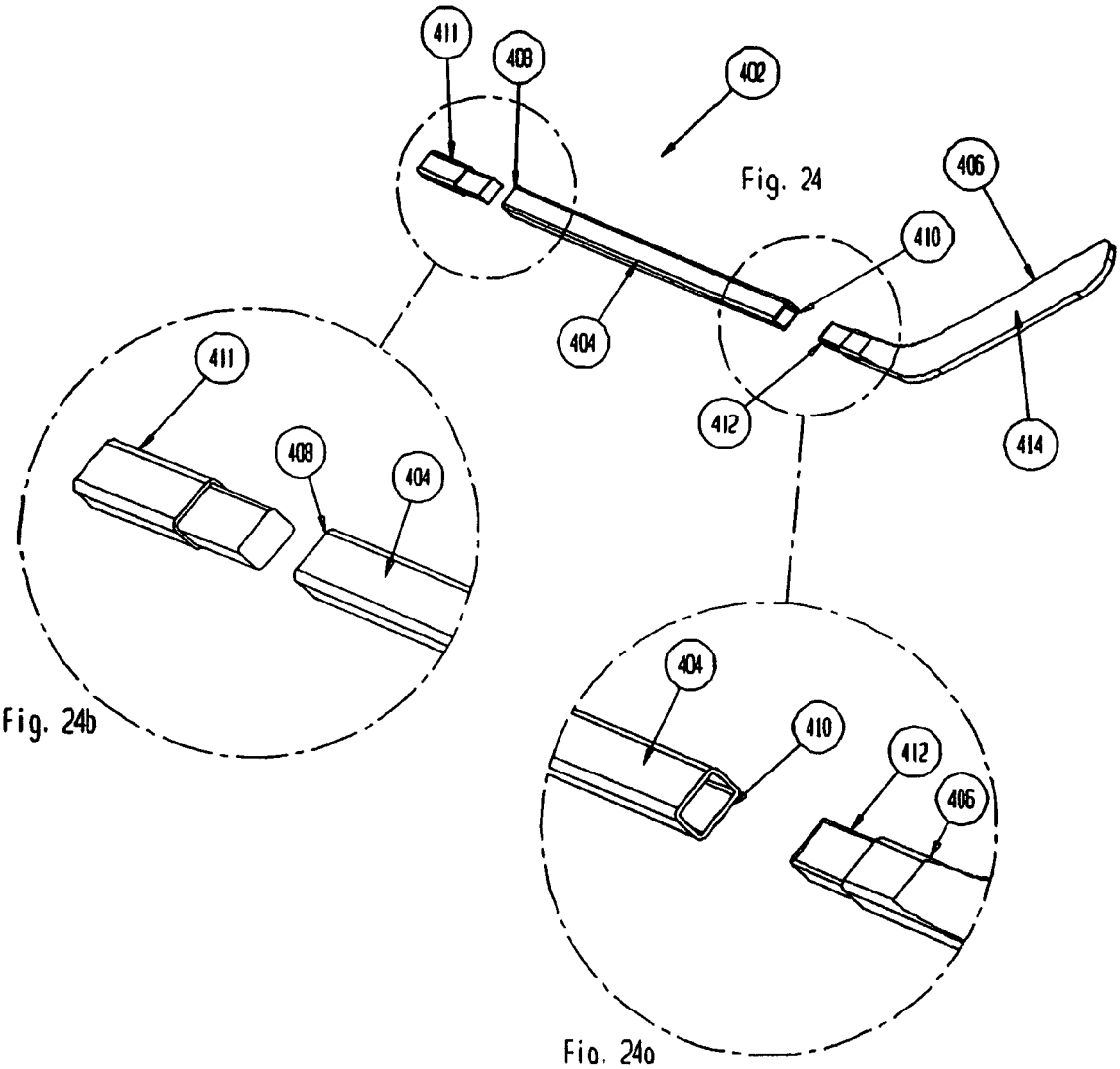
FIG. 24 is an exploded perspective view of a hockey stick.
FIG. 24*b* is a detailed, exploded, perspective view of the hockey stick of FIG. 24.

In another embodiment of the present invention, a blade receiving insert 400 can be used to repair a hollow hockey shaft that is broken in close proximity to a blade receiving end. As depicted in FIGS. 24, 24*a*, 24*b*, a hockey stick 402 can comprise a hollow shaft 404 and a replaceable blade component 406. Hockey stick 402 comprises a gripping end 408 and a receiving end 410. Gripping end 408 can accommodate a shaft plug 411, generally manufactured of solid wood, to increase the length of hockey stick 402. Replaceable blade component 406 comprises an insertion shank 412 and a blade 414. Typically, insertion shank 412 is covered with a heat activatable adhesive. To attach the replaceable blade component 406 to the hollow shaft 404, a user activates the adhesive with a heat source, such as a hair dryer, and then slidingly inserts the insertion shank 412 into the receiving end 410. When the adhesive cools, the hollow shaft 404 and replaceable blade component 406 are fixedly attached resulting in hockey stick 402.

Figure 25:
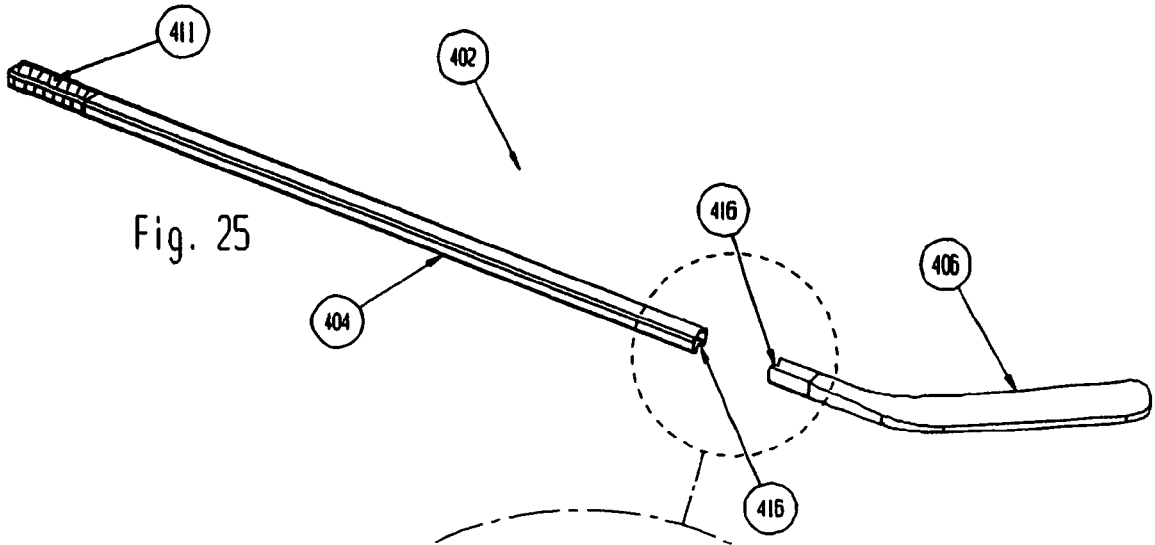
FIG. 25 is an exploded, perspective view of the hockey stick of FIG. 24 fractured proximate the blade.
Figure 25A:
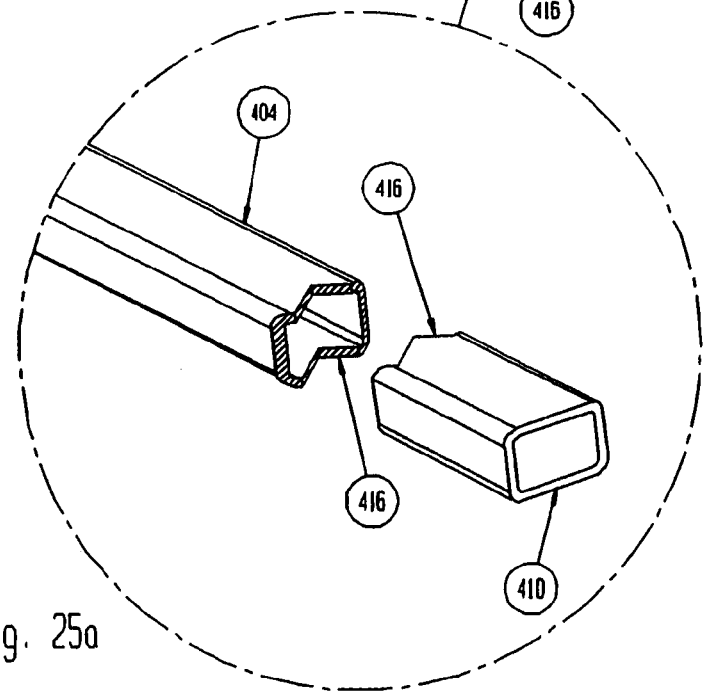
FIG. 25*a* is a detailed, exploded, perspective view of the hockey stick of FIG. 25.

As described previously, hollow shafted hockey sticks have definite advantages but suffer from the greater likelihood of breaking the shaft. In previously discussed embodiments, various apparatus and methods were discussed for fixing a shaft in a location generally central to the shaft. However, it is also possible to break the shaft such that a fracture 416 is proximate the receiving end 410, as shown in FIGS. 25 and 25*a*. With fracture 416, the aforementioned repair apparatus and methods are unsuited for repairing the hollow shaft 404 as they do not include means to receive the insertion shank 412.

Figure 26:
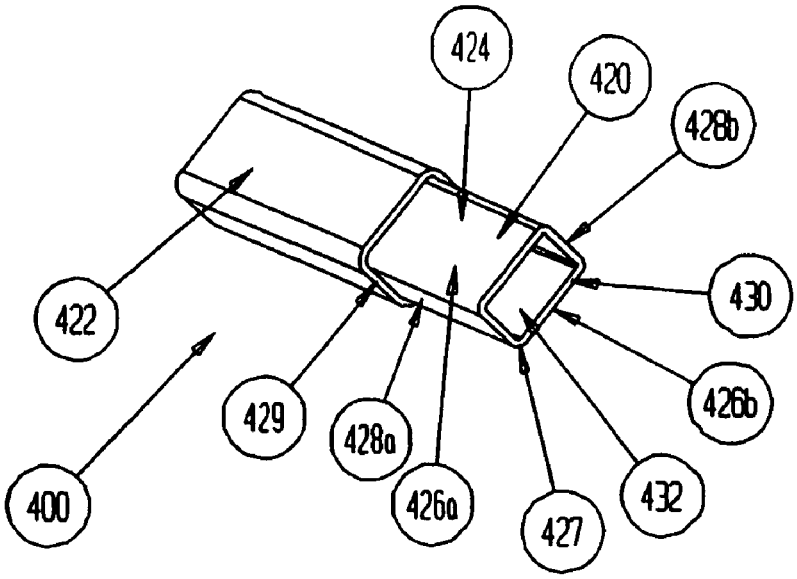
FIG. 26 is a perspective view of a blade receiving insert.
Figure 27:
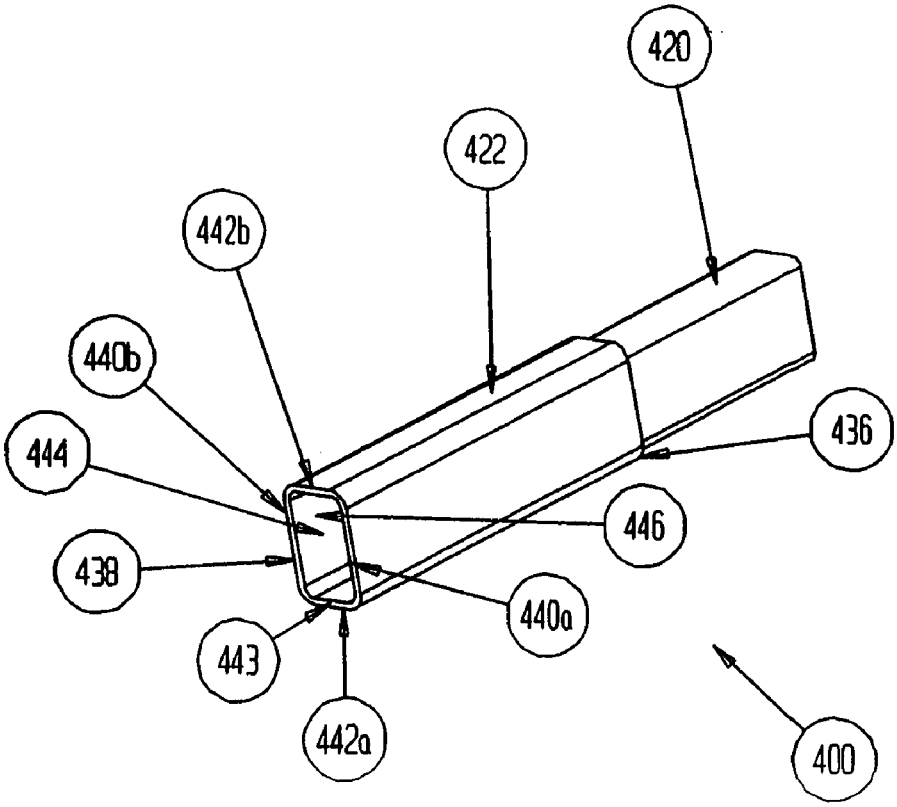
FIG. 27 is a perspective view of the blade receiving insert of FIG. 26.
Figures 29, 30, 31:
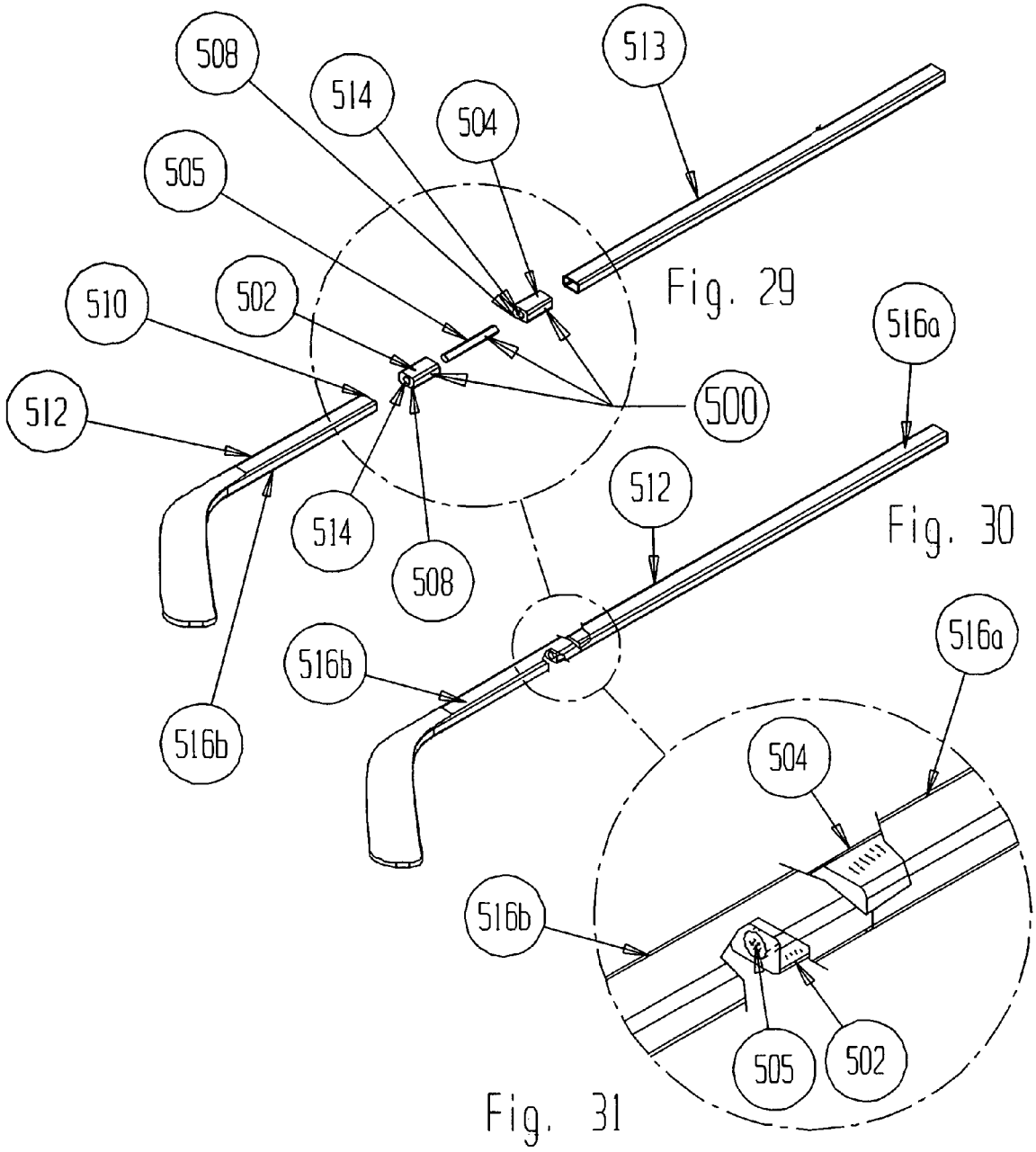
FIG. 29 is an exploded, perspective view of a hollow one-piece hockey stick including the blade receiving insert of FIG. 26.
FIG. 30 is an exploded, perspective view of a hollow shafted hockey stick being repaired with an embodiment of a shaft repair insert.
FIG. 31 is a partially hidden, perspective view of the repaired hockey stick of FIG. 30.

An embodiment of a blade receiving insert 400 of the present invention is depicted in FIGS. 26 and 27. Blade receiving insert 400 comprises an insertion member 420 and a receiving member 422. Blade receiving insert 400 can be fabricated as a single piece or can comprise two or more pieces such as for example, insertion member 420 and receiving member 420 being operably joined. Blade receiving insert 400 can be constructed of any material compatible with hollow shaft 404, for example wood, aluminum, titanium, fiberglass, Kevlar®, a rigid polymer, carbon-fiber, graphite, ABS, ceramics and other composite fibers and materials, either woven or non-woven, and either individually or in any combination thereof. Insertion member 420 has an insertion portion 424 defined by a pair of elongated sides 426*a*, 426*b* and a pair of shortened sides 428*a*, 428*b* defining an insertion portion perimeter cross-section 430, as shown in FIG. 29. Insertion portion 424 is further defined by an insertion end 427 and a perimeter flange 429. Insertion portion perimeter cross-section 430 is substantially equivalent to the cross-section of the insertion shank 412. As depicted, insertion portion perimeter cross-section 430 is rectangular, though it can take other forms typically used with hockey sticks such as ovals, triangles or other alternative geometric configuration and combinations thereof. Insertion member 420 can include various attachment means alone or in combination such as, for example, adhesives such as chemically or heat activated adhesives, one-part or multi-part adhesives, glues, urethanes, polyurethanes, epoxies, acrylics and the like or alternative attachment means such as compressible ridges, a roughened surface, barbs, O-rings or similar features. As depicted, insertion member 420 has a hollow interior 432. Hollow interior 432 can fully extend through the insertion member 420 and the receiving member 422. Alternatively, insertion member 420 can be only partially hollow or completely solid throughout such as, for example, a solid wood member.

Receiving member 422 includes a receiving end 434 and a connecting end 436. Receiving member 422 has a receiving member perimeter cross-section 438, shown in FIG. 27, defined by a pair of elongated sides 440*a*, 440*b* and a pair of shortened sides 442*a*, 442*b*. As depicted, receiving member cross-section 438 is rectangular and is equivalent to the cross-section of shaft 404. Alternatively, receiving member cross-section 438 can take other forms typically used with hockey shafts such as ovals, triangles or alternative geometric configurations and combinations thereof. Furthermore, receiving member cross-section 438 can be of a form different from that of the hockey shaft 404. Receiving member 422 has a hollow receiving interior 444 extending from the receiving end 434 to the connecting end 436. The hollow receiving interior 444 can have a consistent internal cross-section 446 throughout or it can differ at the receiving end 434 and the connecting end 436. Hollow receiving interior 444 can be in communication with the hollow interior 432 of insertion member 420. The internal cross-section 446 at the receiving end 434 is sized to accommodate the slidable insertion of the insertion shank 412. Receiving end 434 can be configured such that an alternative replaceable blade component 406 can be used, even when the insertion shank 412 was not originally designed or compatible for use with the shaft 404.

Figures 28, 28A, 28B:
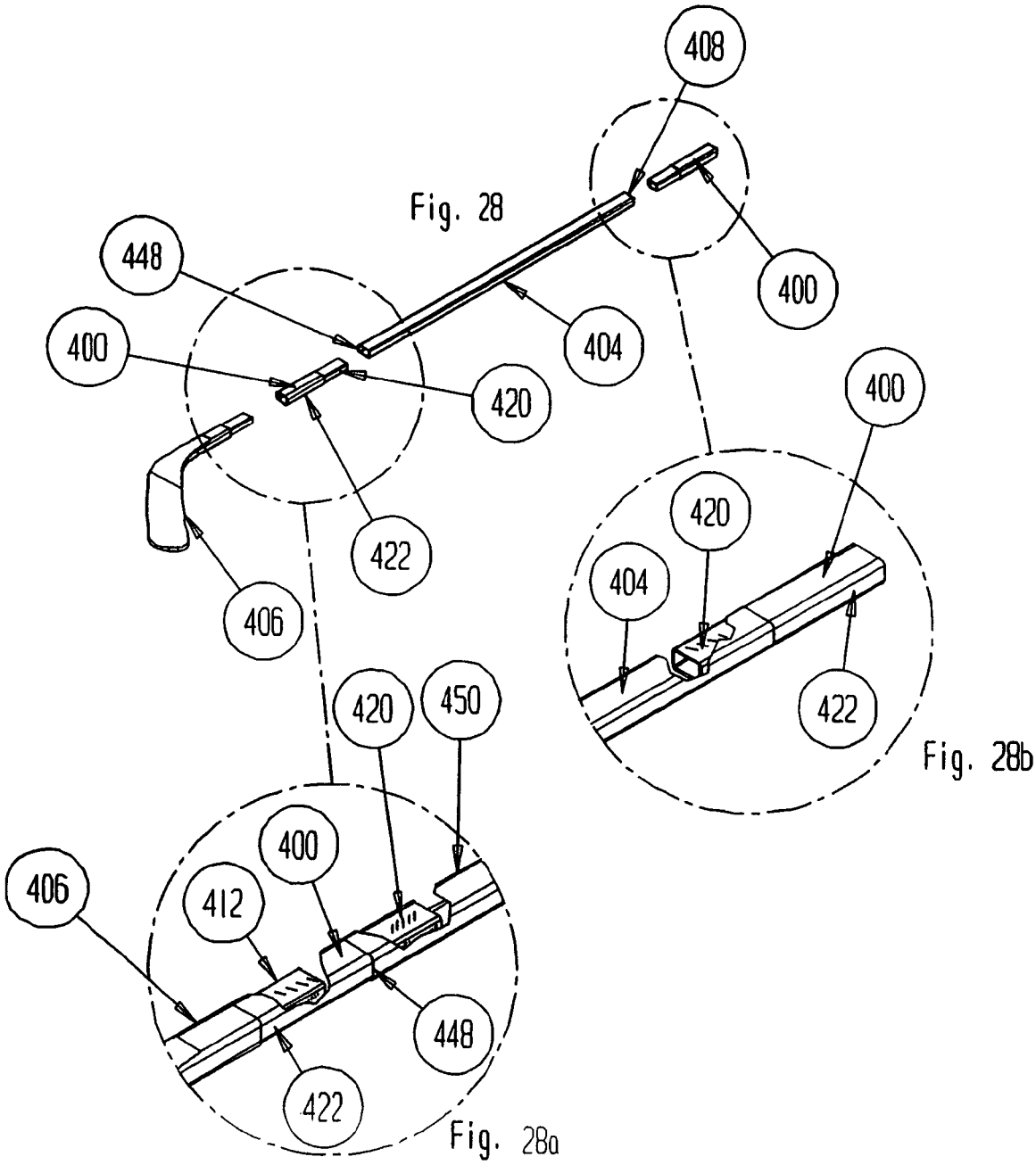
FIG. 28 is an exploded, perspective view of the hockey stick of FIG. 25 including the blade receiving insert of FIG. 26.
FIG. 28*a* is a partially hidden, perspective view of the hockey stick of FIG. 25 repaired with the blade receiving insert of FIG. 26.
FIG. 28*b* is a partially hidden, perspective view of the hockey stick of FIG. 25 repaired with the blade receiving insert of FIG. 26.

To repair hollow shaft 404 with fracture 416, the user positions blade receiving insert 400 such that the insertion member 420 is proximate a shaft fracture surface 448 as shown in FIG. 28. Shaft fracture surface 448 may require sanding or cutting to form substantially straight edges to promote attachment to blade receiving insert 400. If insertion member 420 includes a heat activated adhesive, a heat source is used to activate the adhesive. Insertion member 420 is then slidingly inserted into the hollow shaft 404 until the perimeter flange 429 abuts the shaft fracture surface 448 such that a repaired shaft 450 is formed as shown in FIG. 28*a*.

After assembling repaired shaft 450, a user can attach the replaceable blade component 406 by inserting the insertion shank 412 into the receiving end 434 as illustrated in FIG. 28*a*. In addition to repairing shaft 402, blade receiving insert 400 can be used in place of shaft plug 411 to extend the length of shaft 402, as shown in FIGS. 28 and 28*b*. Blade receiving insert 400 can be used in place of shaft plug 411 when shipping a new hollow shafted hockey stick such as, for example, when a manufacturer anticipates or discovers frequent stick breakage near the replaceable blade component 406. A manufacturer can initially supply blade receiving insert 400 in place of shaft plug 411 so as provide consumers with a future repair ability at the time of initial sale. Upon breakage near blade component 406, the consumer can then remove blade receiving insert 400 from the gripping end 408 such as, for example, by applying heat to warm and loosen a heat activated adhesive, and install the blade receiving insert at shaft fracture surface 448 as previously described. In alternative embodiments, shaft repair sleeve 300, either in a solid form or a wrap, can be used in conjunction with the blade receiving insert 400 to cover the interface between shaft fracture surface 448 and the perimeter flange 429.

In another alternative embodiment, a shaft repair insert 500 depicted in FIG. 29 can comprise a first insert member 502, a second insert member 504 and a rod 505. First insert member 502, second insert member 504 and rod 505 can comprise the same or different materials, for example wood, aluminum, titanium, fiberglass, Kevlar®, a rigid polymer, carbon-fiber, graphite, ABS, ceramics and other composite fibers and materials, either woven or non-woven, and either individually or in any combination thereof. First insert member 502 and second insert member 504 are generally similarly dimensioned so as define an insert cross-section 508 that resembles but is smaller than an internal cross-section 510 of a hollow shaft 512. First insert member 502 and second insert member 504 include a continuous bore 514 sized to accommodate insertion of the rod 505.

Shaft repair insert 500 can be used to repair a top shaft portion 516*a* and a bottom shaft portion 516*b* as shown in FIGS. 29, 30 and 31. First insert member 502 is positioned proximate the top shaft portion 118*a* and the first insert member 502 is slidingly inserted into the top shaft portion 118*a* until it rests flush with the end of top shaft portion 516*a*. Correspondingly, second insert member 504 is positioned proximate the bottom shaft portion 516*b* and the second insert member 504 is slidingly inserted into the bottom shaft portion 516*b* until it rests flush with the end of bottom shaft portion 516*b*. Both first insert member 502 and second insert member 504 can be fixedly positioned within their respective shaft portion with an adhesive such as, for example, chemically or heat activated adhesives, one-part or multi-part adhesives, glues, hot melt, urethanes, polyurethanes, epoxies, acrylics and the like.

Figure 32:
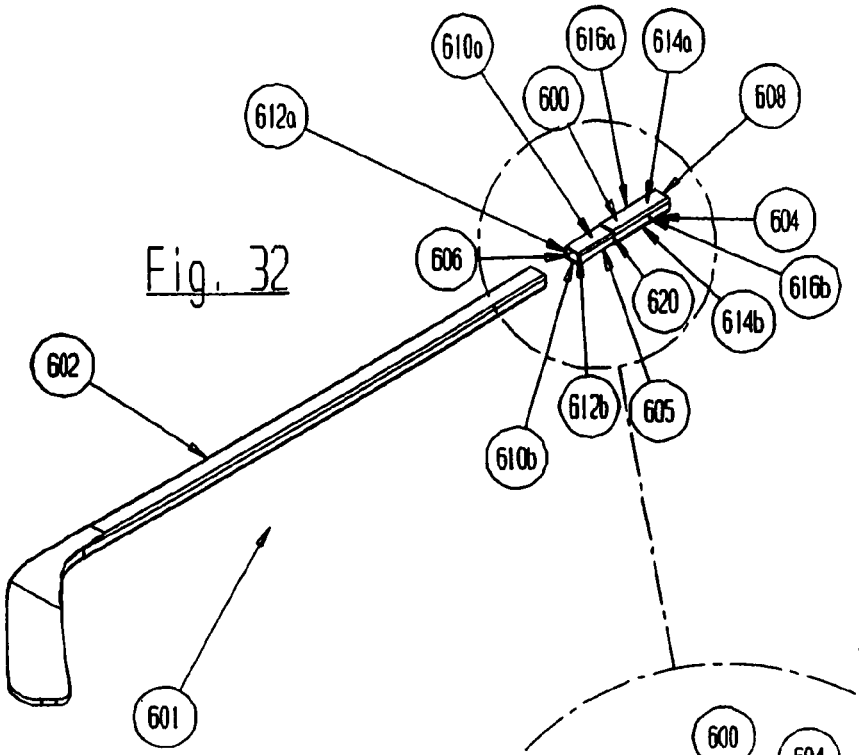
FIG. 32 is an exploded, perspective view of a hockey stick including a shaft extension.

Once first insert member 502 and second insert member 504 are positioned, rod 505 can be slidingly directed into the continuous bore 514 on first insert member 502 and the other end of rod 505 can be directed into the continuous bore of second insert member 504. Top shaft portion 516*a* and bottom shaft portion 516*b* are then directed together and aligned to define a repaired shaft 518, as shown in FIGS. 31 and 32. Rod 505 can be fixedly positioned within first insert member 502 and second insert member 504 using an adhesive such as, for example, chemically or heat activated adhesives, one-part or multi-part adhesives, glues, urethanes, polyurethanes, epoxies, acrylics and the like, so as to retain top shaft portion 516*a* and 516*b* in aligned relation. In certain alternative embodiments, shaft repair sleeve 300 can be incorporated with the shaft repair insert 500 to cover the interface between the top shaft portion 516*a* and bottom shaft portion 516*b*.

Figure 33:
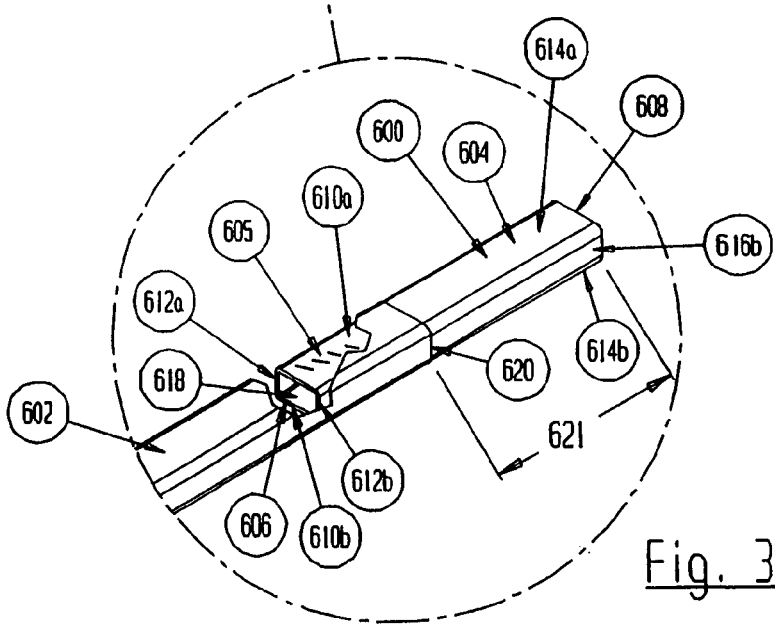
FIG. 33 is a partially hidden, detailed perspective view showing the hockey stick and shaft extension of FIG. 32 in attached relation.
Figure 34:
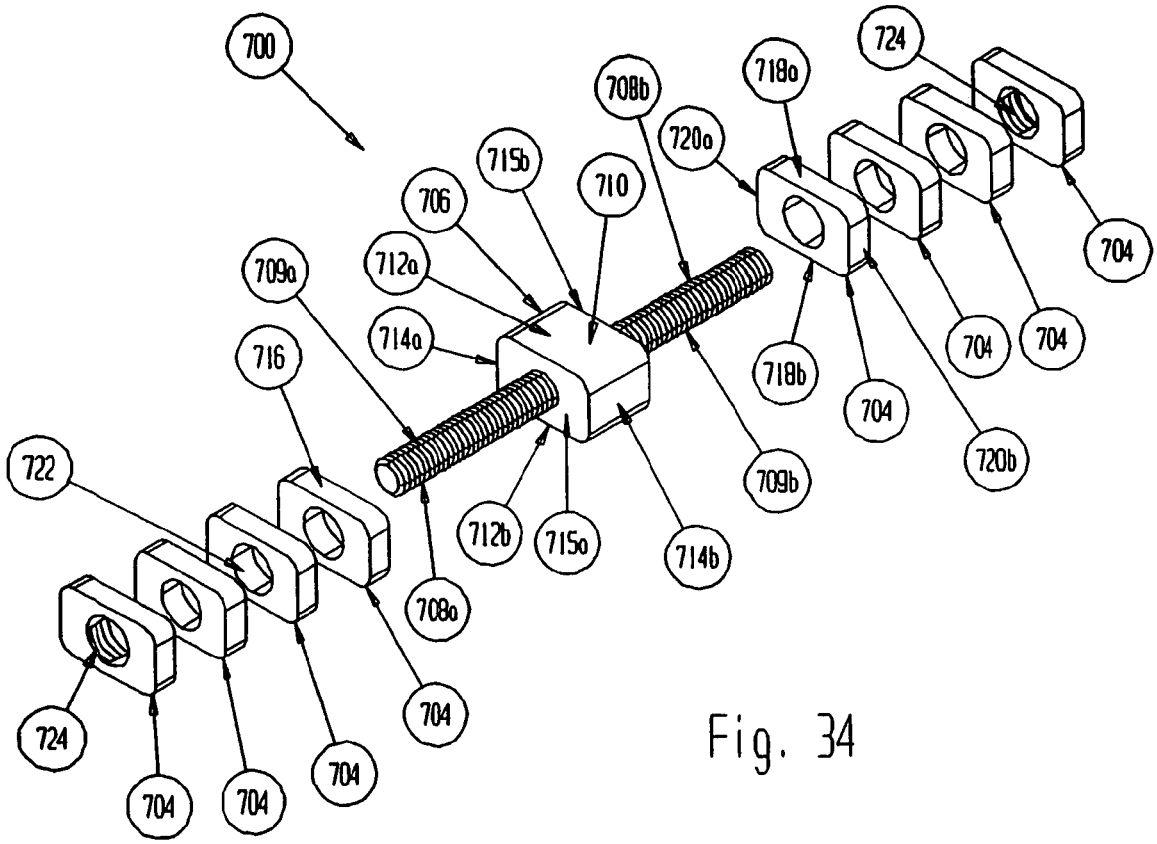
FIG. 34 is an exploded, perspective view of an alternative embodiment of a shaft repair insert.

The present invention can also comprise a hollow shaft extension 600 as depicted in FIGS. 32 and 33. A hockey stick 601 is depicted as comprising a hollow shaft 602 and a hollow shaft extension 600. Hockey stick 601 is depicted as in one-piece composition configuration though it could further comprise a shaft and blade assembly such as previous discussed with reference to hockey stick 402. Hollow shaft extension 600 can resemble blade receiving insert 400 and can comprise a gripping portion 604 and an insertion portion 605. Gripping portion 604 could have an exterior surface, for example, a rubberized, roughened or shaped surface to enhance grip. Hollow shaft extension 600 is further defined by an insertion end 606 and a gripping end 608. Insertion portion 604 comprises a pair of elongated sides 610*a*, 610*b* and a pair of shortened sides 612*a*, 612*b*. Gripping portion 604 comprises a pair of elongated sides

614*a*, 614*b* and a pair of shortened sides 616*a*, 616*b*. As depicted, gripping portion 604 and insertion portion 605 have rectangular cross-sections. Alternatively, gripping portion 604 and insertion portion 605 can have cross-sections resembling other forms typically used with hockey shafts such as ovals, or other alternative geometric configurations and combinations thereof. Gripping portion 604 and insertion portion 605 can further comprise cross-sectional arrangements that differ from one another. Hollow shaft extension 600 can have a hollow interior 618 extending continuously from the insertion end 606 to the gripping end 608. Alternatively, gripping end 608 can include a detachable cap or a permanent end surface. In another alternative embodiment, hollow shaft extension 600 can be solid or only partially hollow such as, for example, a solid insertion portion 605 and a hollow gripping portion 604. Gripping portion 604 and insertion portion 605 cooperatively define an abutment flange 620. Shaft extension 600 can be fabricated such that gripping portion 604 has an extension length 621. Extension length 621 can be any suitable length, such as, for example from one inch in length all the way up to several feet in length. Shaft extension 600 can be provided having a longer extension length than might be anticipated so as to allow a user to tailor, for example by cutting the gripping portion 604, the shaft extension 600 to the desired length. Hollow shaft extension 600 can be constructed of any lightweight material compatible with hollow shaft 602, for example wood, aluminum, titanium, fiberglass, Kevlar®, a rigid polymer, carbon-fiber, graphite, ABS, ceramics and other composite fibers and materials, either woven or non-woven, and either individually or in any combination thereof. Preferably, the hollow shaft extension 600 is comprised of a material capable of imparting similar stick characteristics as the material of which the shaft 602 is comprised. Hollow shift extension 600 can also be incorporated with hollow shaft 602 to tailor stick performance such flex, grip, size and shape.

Hollow shaft extension 600 can be used to properly adjust the overall stick length for a player. For example, hollow shaft extension 600 can be used when hollow shaft 602 suffers a fracture requiring the use of an embodiment of a repair insert as previously described in the present application. Often, the repair will require cutting away a portion of the hollow shaft 602 to create suitable repair surfaces. Through the use of hollow shaft extension 600 having the correct extension length 621, the stick 601 can be restored to its original length while maintaining similar performance characteristics as that of the original stick 601. Hollow shaft extension 600 can also be used to adjust stick length based on growth of the individual, especially for younger players who may experience growth during a single season, such that the useful life of a hollow shaft 602 is extended.

In use, hollow shaft extension 600 is positioned such that the insertion end 606 is proximate the hollow shaft 602. An adhesive such as, for example, chemically or heat activated adhesives, one-part or multi-part adhesives, glues, hot melt, urethanes, polyurethanes, epoxies, acrylics and the like can be applied or activated on insertion portion 605 to secure the hollow shaft extension 600 to the hollow shaft 602. In the case of a heat activated adhesive, a heat source, for example a hairdryer, is used to activate the adhesive. Once the adhesive is applied or activated, the insertion portion 605 is slidingly inserted into the hollow shaft 602 such that the abutment flange 620 is in contact with the hollow shaft 602. Insertion portion 605 is selected to have an almost identical, albeit slightly smaller, cross-section as hollow shaft 602 such that the insertion of insertion portion 605 results in a snug fit. Once the adhesive cures, hollow shaft extension 600 is attached to hollow shaft 602 to form an integral hockey stick 601. Alternatively, insertion portion 605 can include various attachment means such as O-rings, barbs, friction enhancers or other surface treatments to promote the coupling of hollow shaft extension 600 with the hollow shaft 602.

As depicted in FIG. 33, an alternative embodiment of a shaft repair insert 700 can include mechanical means for using expandable seals to further promote repair of hollow shafted hockey sticks. Shaft repair insert 760 can comprise an insertion member 702 and a plurality of compressible and expandable sealing elements 704. Insertion member 702 can comprise a body portion 706 and a pair of opposed, threaded projections 708*a*, 708*b*. Insertion member 702 can be fabricated of a single component or can comprise an assembly of components joined together. Insertion member 702 can be fabricated of various materials such as, for example, wood, aluminum, titanium, fiberglass, Kevlar®, a rigid polymer, carbon-fiber, graphite, ABS, ceramics and other composite fibers and materials, either woven or non-woven, and either individually or in any combination thereof. Threaded projections 708*a*, 708*b* have opposed threads 709*a*, 709*b* such as, for example, threaded projection 708*a* having a left-handed thread while threaded projection 708*b* has a right-handed thread.

Body portion 706 can have an exterior perimeter surface 710 defined by a pair of elongated sides 712*a*, 712*b* and a pair of shortened sides 714*a*, 714*b*. Exterior perimeter surface 710 can be configured to match the cross-sectional shape and size of a hockey stick exterior or exterior perimeter surface 710 can be configured so as to fit within, preferably snugly, a hollow stick shaft. Body portion 706 is further defined by a pair of end surfaces 715*a*, 715*b*.

Sealing elements 704 comprise a sealing perimeter 716 defined by a pair of elongated sides 718*a*, 718*b* and a pair of shortened sides 720*a*, 720*b*. Each sealing element 704 has a throughbore 722 dimensioned to accommodate insertion of the threaded projections 708*a*, 708*b*. At least two distal sealing elements shown as distal elements 704*a* and 704*b* include an internal thread 724 within throughbore 722 that corresponds to the appropriate threaded projection 708*a*, 708*b*. Sealing elements 704 can comprise compressible and expandable materials such as, for example, elastomers, rubber and the like.

In use, sealing elements 704 are slidingly placed over the threaded projections 708*a*, 708*b*. Distal elements 704*a*, 704*b* can then be threaded onto the threaded projections 708*a*, 708*b* such that the sealing elements 704 are retained on the threaded projections 708*a*, 708*b*. Insertion member 702 is then positioned with respect to a broken hockey stick for example, top shaft portion 118*a* and bottom shaft portion 118*b* such that threaded projection 708*a* is oriented toward top shaft portion 118*a* and threaded projection 708*b* is oriented toward bottom shaft portion 118*b*. Threaded portion 708*a* is slidingly inserted into top shaft portion 118*a* such that the distal element 704*a* and retained sealing elements 704 are within the top shaft portion 118*a*. Similarly, threaded portion 708*b* is slidingly inserted into bottom shaft portion 118*b* such that the distal element 704*b* and retained sealing elements 704 are within the top shaft portion 118*b*. During insertion of the distal elements 704*a*, 704*b* and sealing elements 704 into the hollow shaft, the user can be required to rotatably manipulate the elements so as to match the sealing perimeter 716 with the interior shaft cross-section. Depending upon the size and shape of body portion 706, insertion of the threaded portion 708*a* into the top shaft portion 118*a* is completed when either end surface 715*a* abuts the top shaft portion 118*a* or approximately half of the body portion 706 is within the top shaft portion 118*a*. Similarly, insertion of the threaded portion 708*b* into the bottom shaft portion 118*b* is completed when either end surface 715*b* abuts the bottom shaft portion 118*b* or approximately half of the body portion 706 is within the bottom shaft portion 118*b* wherein top shaft portion 118*a* and bottom shaft portion 118*b* are abutted. The top shaft portion 118*a* and bottom shaft portion 118*b* are then oppositely, rotatably twisted along their longitudinal axis wherein distal elements 704*a*, 704*b* are advanced up threads 709*a*, 709*b* toward the end surfaces 715*a*, 715*b*. As the distal elements 704*a*, 704*b* approach the end surfaces 715*a*, 715*b*, the distal elements 704*a*, 704*b* capture the sealing elements 704 and correspondingly advance the sealing elements 704 proximate the end surfaces 715*a*, 715*b*. Distal elements 704*a*, 704*b* begin compressing the sealing elements 704 against the end surfaces 715*a*, 715*b* causing expansion of the sealing perimeter 716 such that sealing element 704 engagably grips the interior wall of the hollow shaft. Top shaft portion 118*a* and bottom shaft portion 118*b* are twisted until the distal elements 704*a*, 704*b* are tight and top shaft portion 118*a*, 118*b* are suitably aligned and unseparable. In an alternative embodiment, sealing elements 704 and body portion 706 can be replaced with opposed wedges on the threaded portions 708*a*, 708*b* such that advancement of the distal elements 704*a*, 704*b* causes the wedges to engage and grip the interior wall of the hollow shaft across the interface between the top shaft portion 118*a* and the bottom shaft portion 118*b*.

Figures 35, 36, 37:
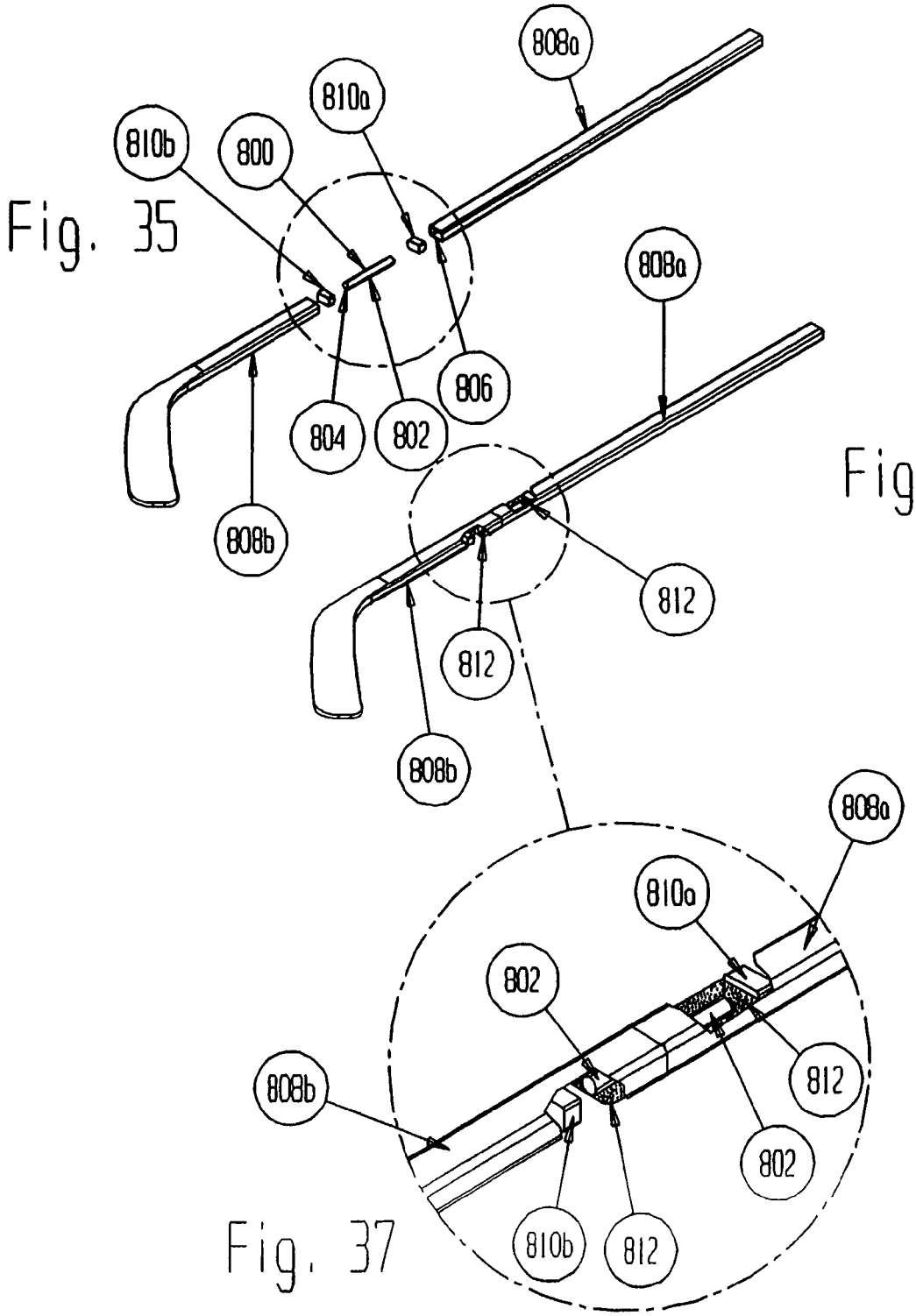
FIG. 35 is an exploded, perspective view of a broken hockey stick and an embodiment of a shaft repair insert.
FIG. 36 is a partially hidden, perspective view of the broken hockey stick of FIG. 35 repaired using the shaft repair insert of FIG. 35.
FIG. 37 is a partially hidden, detailed, perspective view of the repaired hockey stick of FIG. 36.

Referring to FIGS. 35, 36 and 37, another embodiment of a shaft repair inset 800 is depicted. Shaft repair insert 800 comprises a body member 802 such as, for example a member having a circular, rectangular or other geometric cross-section 804. Body member 802 can comprise materials such as, for example, wood, aluminum, titanium, fiberglass, Kevlar®, a rigid polymer, carbon-fiber, graphite, ABS, ceramics and other composite fibers and materials, either woven or non-woven, and either individually or in any combination thereof. Cross-section 804 is configured and sized so as to easily fit within a hollow interior 806 of a top shaft portion 808*a* and a bottom shaft portion 808*b*. Shaft repair insert 800 further comprises a top plug 810*a* and a bottom plug 810*b*. Top plug 810*a* and bottom plug 810*b* can comprise any material suitable for insertion into the top shaft portion 808*a* and bottom shaft portion 808*b* such that the top plugs 810*a*, 810*b* substantially fill, or plug, the shaft portions 808*a*, 808*b*.

To use shaft repair insert 800, a user first inserts the top plug 808*a* into the top shaft portion 810*a* by pushing the top plug 808*a* with the body member 802. Top plug 808*a* is inserted until body member 802 resides fully within the top shaft portion 810*a*. Bottom plug 808*b* is then insertably positioned within bottom shaft portion 810*b* to a depth equal to approximately one-half the length of the body member 802. A suitable flowable adhesive, such as for example, a two-part epoxy, is directed into the top shaft portion 810*a* so as to fill the open volume of the shaft surrounding the body member 802. Other suitable adhesives can comprise chemically or heat activated adhesives, one-part or multi-part adhesives, glues, hot melt, urethanes, polyurethanes, epoxies, acrylics and the like. Top shaft portion 810*a* should be oriented in a substantially vertical disposition so as to avoid spilling the flowable adhesive. Top plug 808*a* acts essentially as a dam so as to substantially prevent the flowable adhesive from passing beyond the top plug 808*a* and down into the remaining portion of the top shaft portion 810*a*. Next, the bottom shaft portion 810*b* is placed above the top shaft portion 810*a* and is directed into a vertically abutted and aligned relation with the top shaft portion 810*a*. While holding the bottom shaft portion 810*b* and top shaft portion 810*a* in aligned relation, the shaft portions 810*a*, 810 are quickly rotated so as to be in an opposed vertical disposition with the bottom shaft portion 810*b* below the top shaft portion 810*a*. This causes the body member 802 and flowable adhesive to fall into the bottom shaft portion 810*a* wherein the body member 802 and flowable adhesive is retained by the bottom plug 808*b*. Because of the positioning of bottom plug 808*b*, approximately half of the body member 802 and half of the flowable adhesive is located on each side of the interface between the top shaft portion 810*a* and bottom shaft portion 810*b*. In a preferred embodiment, the flowable adhesive begins to cure or set-up within a matter of minutes. Generally, the flowable adhesive conforms to the interior surfaces of the top shaft portion 810*a* and bottom shaft portion 810*b*. As the flowable adhesive can conform to differing hockey shaft shapes, small cross-sectioned, irregular and loose fitting shaft repair inserts 800 such as, for example, loose fitting versions of shaft repair insert 200, can be used to repair a variety of dimensionally and geometrically different hockey sticks. In some embodiments, shaft repair insert can comprise a plurality of body members 802. In some embodiments, the flowable adhesive can comprise an expanding material such as, for example, expanding materials commonly used in the packaging and shipment of goods.

While the present invention has been described with reference to preferred embodiments, it will be obvious to one skilled in that art that various changes and modifications could be incorporated without departing from the spirit and scope of the present invention. It will also be obvious to one skilled in the art that the aforementioned and described embodiments can be used in a variety of combinations to promote the repair and continued used of hollow shafted hockey sticks.

What is claimed is:

1. A method for repairing a broken hockey stick shaft comprising:

providing a broken, hollow shafted hockey stick having a first broken shaft portion and a second broken shaft portion; and joining the first broken shaft portion to the second broken shaft portion with a shaft repair insert wherein a first insertion end of the shaft repair insert is inserted into the first broken shaft portion and a second insertion end of the shaft repair is inserted into the second broken shaft portion, the shaft repair insert operably connecting the first broken shaft portion and the second broken shaft portion in an aligned relation to present a substantially continuous hockey stick shaft.

2. The method of claim 1, further comprising:

positioning a shaft repair sleeve over both the first broken shaft portion and the second broken shaft portion to retain the first broken shaft portion and the second broken shaft portion in aligned relation.

3. The method of claim 2, wherein the shaft repair sleeve is fixedly positioned with a positioning process selected from the group comprising a thermal heating process, a wrapping process, an adhesive process and a chemical bonding process.

4. The method of claim 1, further comprising:

preparing interior surfaces of the first broken shaft portion and the second broken shaft portion for bonding, the act of preparing interior surfaces comprising roughening the interior surfaces with a tool to promote bonding between the shaft repair insert and the interior surfaces.

5. The method of claim 4, wherein preparing interior surfaces further comprises cleaning the interior surfaces with a solvent to promote bonding between the shaft repair insert and the interior surfaces.

6. The method of claim 1, further comprising:

preparing fracture surfaces on the first broken shaft portion and the second broken shaft portion for bonding, the act of preparing fracture surfaces comprising smoothing the fracture surfaces to provide smooth fracture surfaces that are substantially perpendicular to a longitudinal axis of the first broken shaft portion and the second broken shaft portion.

7. The method of claim 6, wherein preparing fracture surfaces comprises sanding or sawing the fracture surfaces to provide smooth fracture surfaces.

8. A system for repairing a broken, hollow-shafted hockey stick comprising:

a shaft repair insert comprising at least one insert body having a first insertion end and a second insertion end, the first insertion end having a first cross-section smaller than a first hollow portion of a first shaft member of the hollow-shafted hockey stick, the second insertion end having a second cross-section smaller than a second hollow portion of a second shaft member of the hollow-shafted hockey stick;

a pair of shaft plugs adapted for insertion into the hollow-shafted hockey stick; and a flowable adhesive, wherein one plug is slidably inserted into the first hollow portion and the second plug is slidably inserted into the second hollow portion, wherein the first insertion end is slidably inserted into the first hollow portion and the second insertion end is slidably inserted into the second hollow portion, and wherein the expanding, self-hardening composition is directed into the first hollow portion and the second hollow portion whereby expansion of the expanding, self-hardening composition causes the shaft repair insert and expanding self-hardening composition to cooperatively join the first shaft member and the second shaft member to present a substantially continuous hockey stick shaft.

9. The system of claim 8, wherein the expanding self-hardening composition comprises an epoxy, a polyester, an acrylic, a glue, a urethane foam and a thermoset polymer.

10. A hollow shafted hockey stick comprising:

a hollow shaft having a blade end and a gripping end; and a repair insert removably attached to the gripping end, the repair insert having an insertion portion adapted for insertion into the hollow shaft and a receiver portion adapted to receive a blade hozel of a stick blade assembly, the repair insert fabricated from a single component selected from the group comprising wood, aluminum, titanium, graphite, Kevlar®, carbon fiber, a ceramic, a composite weave, and fiberglass, wherein the repair insert can be repositioned and attached proximate a stick fracture, and wherein the repair insert can detachably accept the stick blade assembly so as to define a repaired hockey stick.

11. The hollow shafted hockey stick of claim 10, wherein the insertion portion comprises a solid insertion member.

12. The hollow shafted hockey stick of claim 10, wherein the receiver portion comprises a receiver length selected such that the receiver portion and the hollow shaft cooperatively and variably define a stick length.

13. A stick shaft repair assembly comprising:

an insert member having a first insertion end and a second insertion end, the first insertion end having a first cross-section adapted for insertion into a first hollow portion of a first shaft member of a hockey stick, the second insertion end having a second cross-section adapted for insertion into a second hollow portion of a second shaft member of the hockey stick; and a wrappable member adapted for positioning over an interface between the first hollow portion and the second hollow portion, wherein the insert member and the wrappable member cooperate to retainably join the first hollow portion and the second hollow portion in aligned relation so as to define a substantially continuous hockey stick shaft.

14. The stick shaft repair assembly of claim 13, wherein the wrappable member is selected from the group comprising: a sleeve, a tape and a sheet.

15. A repaired, hollow-shafted hockey stick comprising:

a first broken hollow shaft portion defined between a gripping end and a first fracture end;

a second broken hollow shaft portion defined between a stick blade and second fracture end; and a repair insert having a first shaft insertion portion and a second shaft insertion portion, wherein the first shaft insertion portion is adapted for insertion into the first fracture end and the second shaft insertion portion is adapted for insertion into the second fracture end such that the repair insert operably connects the first broken hollow shaft portion and the second broken hollow shaft portion to define the repaired, hollow-shafted hockey stick.

16. The repaired, hollow-shafted hockey stick of claim 15, further comprising:

a repair sleeve externally positioned over a shaft interface at the first fracture end and the second fracture end wherein the repair sleeve cooperatively assists the repair insert in operably connecting the first broken hollow shaft portion and the second broken hollow shaft portion.

17. The repaired, hollow-shafted hockey stick of claim 15, wherein the repair insert comprises a spacer portion between the first shaft insertion portion and the second shaft insertion portion, the spacer portion presenting a first flanged surface for interfacing with the first fracture end and a second flanged surface for interfacing with the second fracture end.

18. The repaired, hollow-shafted hockey stick of claim 17, wherein the spacer portion has a spacer cross-section substantially resembling a first cross-section of the first broken hollow shaft portion and a second cross-section of the second broken hollow shaft portion so as to provide a substantially uninterrupted repaired stick shaft.

19. The repaired, hollow-shafted hockey stick of claim 15, further comprising:

an extension insert having a gripping portion arid a gripping insert portion wherein the gripping insert portion is inserted into the gripping end.

* * * * *